US007333754B2

(12) United States Patent
Fujita et al.

(10) Patent No.: US 7,333,754 B2
(45) Date of Patent: Feb. 19, 2008

(54) IMAGE FORMING APPARATUS AND METHOD USING LIQUID DEVELOPMENT

(75) Inventors: Toru Fujita, Nagano-ken (JP); Ken Ikuma, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 131 days.

(21) Appl. No.: 10/940,430

(22) Filed: Sep. 14, 2004

(65) Prior Publication Data

US 2005/0078984 A1 Apr. 14, 2005

(30) Foreign Application Priority Data

Sep. 17, 2003 (JP) ..... 2003-324198
Sep. 25, 2003 (JP) ..... 2003-332973
Oct. 15, 2003 (JP) ..... 2003-355403

(51) Int. Cl.
*G03G 15/10* (2006.01)

(52) U.S. Cl. ..... 399/249

(58) Field of Classification Search ..... 399/249
See application file for complete search history.

(56) References Cited

U.S. PATENT DOCUMENTS 5,521,685 A * 5/1996 Barnes et al. ..... 399/249
5,815,779 A * 9/1998 Abramsohn ..... 399/249
5,848,322 A * 12/1998 Chen et al. ..... 399/57
6,466,756 B1 * 10/2002 Nakashima et al. ..... 399/249
6,466,757 B2 10/2002 Itaya et al.
6,694,112 B2 2/2004 Sasaki et al.
2001/0021323 A1 9/2001 Itaya et al.
2002/0021429 A1 2/2002 Sasaki et al.
2002/0098016 A1 * 7/2002 Kurotori et al. ..... 399/249 X
2002/0110390 A1 * 8/2002 Park et al. ..... 399/249 X
2002/0159801 A1 * 10/2002 Nakashima et al. .... 399/249 X
2003/0067529 A1 * 4/2003 May et al. ..... 347/103
2003/0186157 A1 * 10/2003 Teraoka et al. ..... 430/114
2004/0086291 A1 5/2004 Sasaki et al.
2005/0141924 A1 * 6/2005 Kellie ..... 399/237

FOREIGN PATENT DOCUMENTS

JP 05-289528 11/1993
JP 2001-100533 4/2001
JP 2001-228717 8/2001
JP 2001-356607 12/2001
JP 2002-278294 9/2002
JP 2002-296918 10/2002
JP 2003-228242 8/2003
JP 2003-255717 9/2003
JP 2003-280397 10/2003

* cited by examiner

*Primary Examiner*—David M. Gray
*Assistant Examiner*—Erika J. Villaluna
(74) *Attorney, Agent, or Firm*—Hogan & Hartson LLP

(57) ABSTRACT

Squeegee rollers are disposed between a primary transferring position and a secondary transferring position on an intermediate transfer roller facing against the intermediate transfer roller. The squeegee rollers are movable between a contacting position to contact with liquid developer on the intermediate transfer roller and a clear-off position to stay out of contact therewith. Being positioned at the contacting position, the squeegee rollers strip off carrier liquid from the intermediate transfer roller. The stripped carrier liquid is returned back to a tank which stores liquid developer.

9 Claims, 23 Drawing Sheets

IMAGE FORMING APPARATUS AND METHOD USING LIQUID DEVELOPMENT

CROSS REFERENCE TO RELATED APPLICATION

The disclosure of Japanese Patent Applications enumerated below including specification, drawings and claims is incorporated herein by reference in its entirety:

No. 2003-324198 filed Sep. 17, 2003;
No. 2003-332973 filed Sep. 25, 2003; and
No. 2003-355403 filed Oct. 15, 2003.

BACKGROUND OF THE INVENTION

1. Field of the Invention

The present invention relates to an electrophotographic image forming technique applied to printers, copiers, facsimiles and the like, and more particularly to an image forming technique adopting a liquid development as a development system.

2. Description of the Related Art

There has conventionally been known an electrophotographic image forming apparatus which operates as follows. A charged photosensitive member is exposed to light by exposure device so as to form an electrostatic latent image thereon. Development device causes toner to adhere to the photosensitive member thereby visualizing the electrostatic latent image into a toner image. The resultant toner image is primarily transferred onto an intermediate transfer medium such as an intermediate transfer belt or intermediate transfer drum. The toner image on the intermediate transfer medium is transported to a secondary transferring position, at which the toner image is secondarily transferred to a recording medium such as a transfer sheet. As a development system adopted by the development device, there is known a liquid development system using liquid developer with toner dispersed in carrier liquid. The liquid development system has advantages that the liquid developer provides high-resolution images because an average particle diameter of toner is 0.1 to 2 μm, that the liquid developer provides uniform images because of high liquidity of the solution, and such. In this connection, a variety of image forming apparatuses of the liquid development system have been proposed.

For instance, an image forming apparatus disclosed in Japanese Unexamined Patent Publication No. 2002-296918 is designed to improve image quality by removing excessive liquid developer, or particularly an excessive carrier liquid from the intermediate transfer medium before the developed image (toner image) is transferred to the recording medium such as the transfer material.

According to an image forming apparatus disclosed in Japanese Unexamined Patent Publication No. 2001-228717, a removing member such as formed of a roller is provided between a development position and a transferring position. The removing member is applied with a bias voltage higher than a potential of a toner layer but lower than a potential of the photosensitive member (non-image area), thereby removing excessive toner from the photosensitive member, prior to the transfer of the developed image (toner image) to the recording medium such as a transfer sheet. In this manner, the image is prevented from sustaining fogs and image quality is improved.

SUMMARY OF THE INVENTION

By the way, when such images are formed continuously having a high image occupation ratio which is a ratio of an image portion to an electrostatic latent image for instance, a large amount of toner adheres on a photosensitive member, while only a small amount of a carrier liquid moves to the photosensitive member from a container which stores a liquid developer. Conversely, when images having a low image occupation ratio are formed successively, since only a small amount of toner adheres on the photosensitive member, more carrier liquid moves to the photosensitive member from the container than during formation of images which have a high image occupation ratio. Thus, the amount of carrier liquid contained in liquid developer which moves to a photosensitive member from the container largely changes depending on an image occupation ratio, and this change in turn leads to a change of a toner density in the liquid developer which remains within the container.

However, the apparatus disclosed in Japanese Unexamined Patent Publication No. 2002-296918 is merely arranged to remove the carrier liquid from the intermediate transfer medium according to the type of the transfer material. The apparatus does not consider the toner density of the liquid developer in the container and thence, is unable to suppress the fluctuations of the toner density of the liquid developer in the container. Accordingly, the liquid developer in the container is varied in the toner density. In cases, the liquid developer may be degraded in development quality in the formation of the toner image by developing the electrostatic latent image on the photosensitive member. As a result, the apparatus fails to ensure that favorable images are formed in a reliable manner.

On the other hand, the apparatus disclosed in Japanese Unexamined Patent Publication No. 2002-296918 cannot respond to a change of the amount of carrier liquid on the intermediate transfer medium. As a result a change of the amount of carrier liquid on the intermediate transfer medium could change a secondary transfer condition and make it difficult to transfer favorably. Hence, one of important control factor to achieve a good image quality is to adjust the amount of carrier liquid contained in the liquid developer on the intermediate transfer medium.

According to the arrangement of the apparatus disclosed in Japanese Unexamined Patent Publication No. 2001-228717, as well, it is impossible to remove the toner not transferred at the transferring position. In cases, therefore, post-transfer residual toner may remain in the non-image area and the image area on the photosensitive member after the image is transferred (primary transfer) from the photosensitive member to the transfer medium. Similarly, the post-transfer residual toner may remain on the intermediate transfer medium after the image is transferred (secondary transfer) from the intermediate transfer medium to the recording medium such as the transfer sheet. Such post-transfer residual toner may often adhere to the photosensitive member after the primary transfer or to the intermediate transfer medium after the secondary transfer, and hence it is difficult for a cleaner to remove such a post-transfer residual toner. In consequence, the post-transfer residual toner adversely affects the images, constituting a causative factor of the degradation of image quality.

Accordingly, a first object of the present invention is to provide an image forming apparatus adapted to suppress the variations of the toner density of the liquid developer in the container, and a method thereof.

A second object of the present invention is to provide an image forming apparatus adapted to ensure the good image quality by suppressing the variations of a condition of the transfer (secondary transfer condition) from the intermediate transfer medium to the recording medium, and a method thereof.

A third object of the present invention is to provide an image forming apparatus adapted to ensure the good image quality by removing thoroughly the post-transfer residual toner remaining on a first image carrier after the transfer of the toner image from the first image carrier to a second image carrier, and a method thereof.

According to a first aspect of the present invention, there is provided an image forming apparatus including a container for storing liquid developer with toner dispersed in carrier liquid, in which a toner image is formed by developing an electrostatic latent image on a latent image carrier using the liquid developer stored in the container and the toner image is transferred onto a transfer medium, the apparatus comprising: a collecting device that collects the carrier liquid from the liquid developer adhering onto the transfer medium and returns the carrier liquid back into the container, wherein a returning amount of the carrier liquid returned by the collecting device back into the container is adjustable.

According to a second aspect of the present invention, there is provided an image forming apparatus operating to form a toner image by developing an electrostatic latent image on a latent image carrier using liquid developer with toner dispersed in carrier liquid, to primarily transfer the toner image onto an intermediate transfer medium at a primary transferring position, to transport the toner image on the intermediate transfer medium toward a secondary transferring position, and to secondarily transfer the toner image onto a recording medium, the apparatus comprising: an adjusting device that adjusts an amount of carrier liquid contained in the liquid developer adherent to the intermediate transfer medium between the primary transferring position and the secondary transferring position, wherein a ratio between the toner and the carrier liquid carried on the intermediate transfer medium is controllable by the adjusting device.

According to a third aspect of the present invention, there is provided an image forming apparatus comprising: a first image carrier that rotates in a predetermined rotational direction while carrying thereon a toner image formed using liquid developer with toner dispersed in carrier liquid, thereby transporting the toner image toward a transferring position; a transferring device that transfers the toner image on the first image carrier onto a second image carrier at the transferring position; a cleaning device disposed at place downstream from the transferring position with respect to the rotational direction of the first image carrier that removes the liquid developer, carried on the first image carrier, from the first image carrier; and a dispersing-state adjusting device disposed at place between a cleaning position at which the cleaning device removes the liquid developer carried on the first image carrier and the transferring position that adjusts a dispersing state of toner contained in the liquid developer carried on the first image carrier.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE PREFERRED EMBODIMENTS

First Preferred Embodiment

Figure 1:
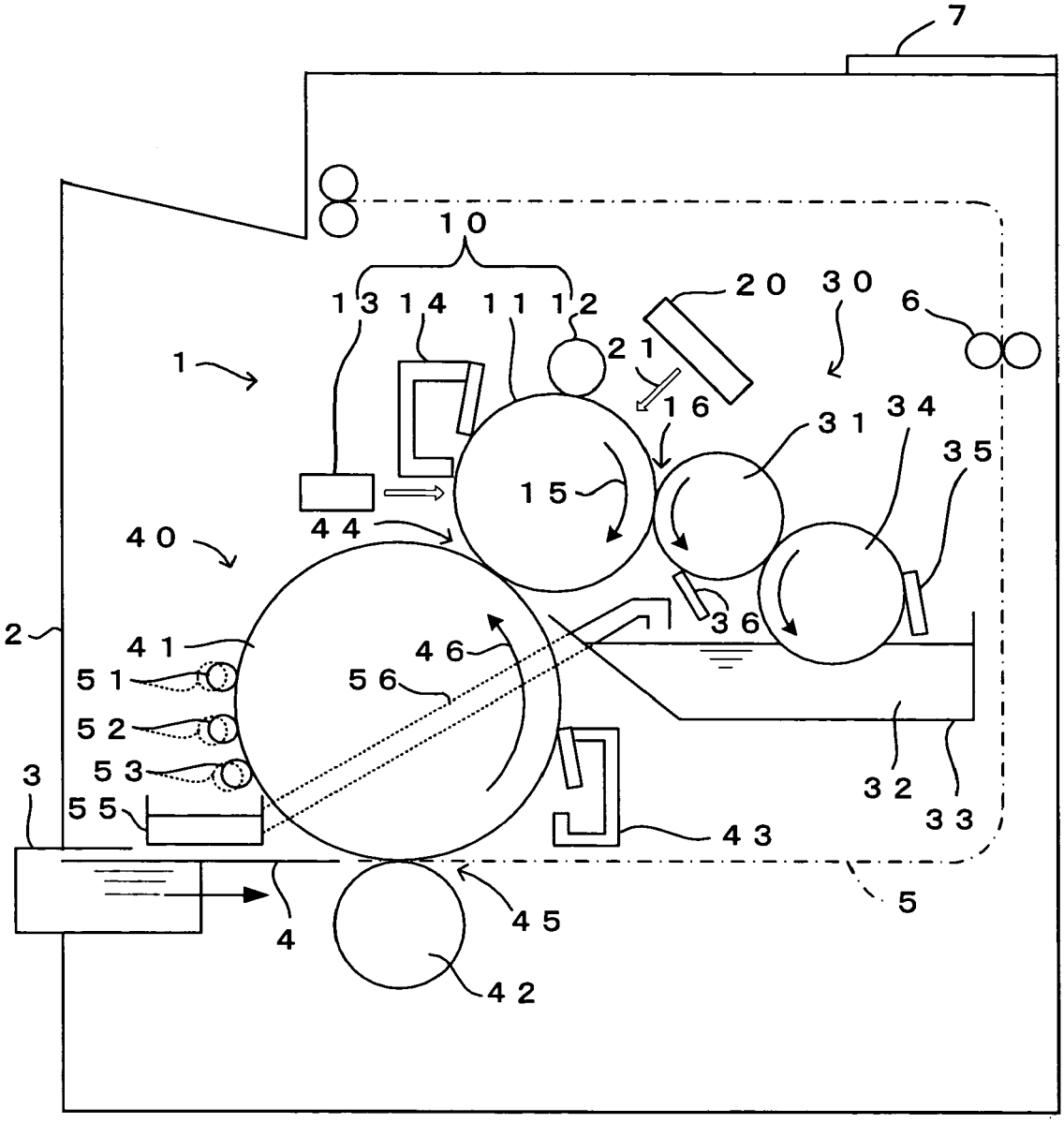
FIG. 1 is a drawing which shows an internal structure of a printer which is a first preferred embodiment of the present invention.
Figure 2:
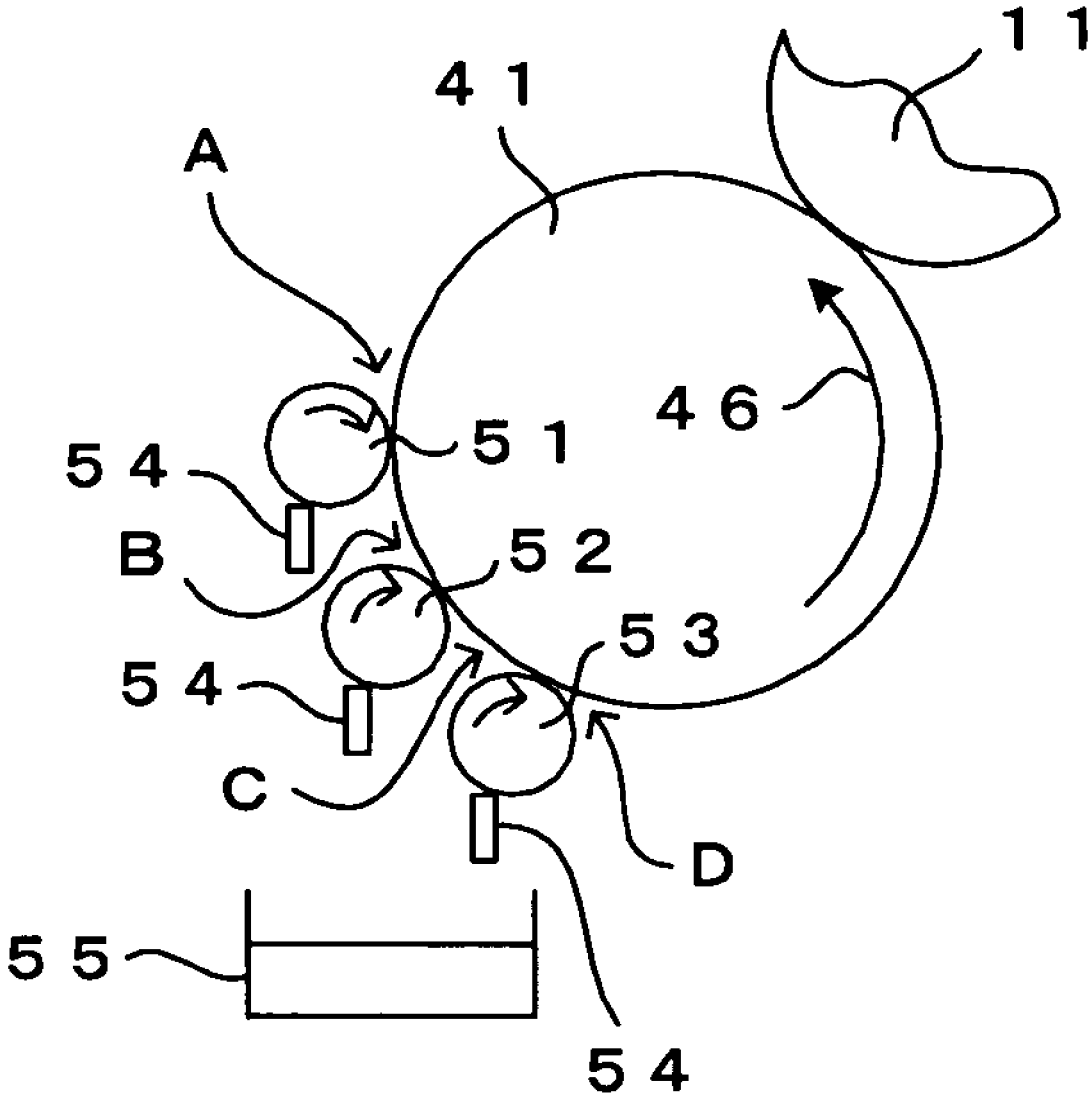
FIG. 2 is an enlarged view of a principal part of FIG. 1.
Figure 3:
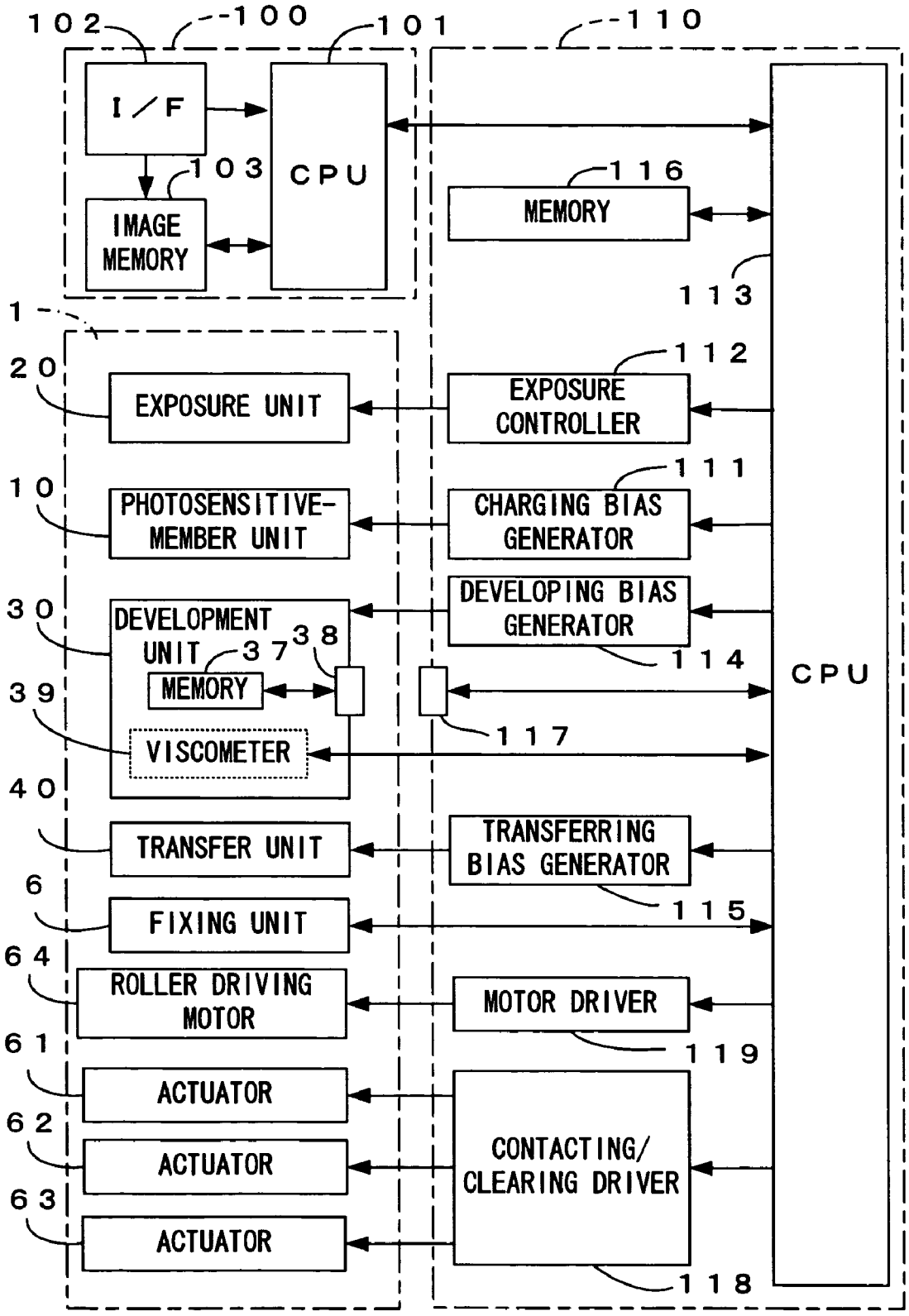
FIG. 3 is a block diagram showing an electric structure of the printer of FIG. 1.

FIG. 1 is a drawing which shows an internal structure of a printer as an image forming apparatus according to a first preferred embodiment of the present invention, FIG. 2 is an enlarged view of a principal part of FIG. 1, and FIG. 3 is a block diagram showing an electric structure of the printer. This printer is an image forming apparatus using the liquid development process which forms a monochrome image using a liquid developer of black (K). As a print instruction signal containing an image signal is fed to a main controller 100 from an external apparatus such as a host computer, an engine controller 110 controls respective portions of an engine part 1 in accordance with a control signal received from the main controller 100, and images which correspond to the image signal mentioned above are printed on a transfer paper, a copy paper and other general paper (hereinafter referred to as a "transfer paper") 4 conveyed from a paper cassette 3 which is disposed in a lower portion of an apparatus body 2.

The engine part 1 mentioned above comprises a photosensitive member unit 10, an exposure unit 20, a developer unit 30, a transfer unit 40, etc. Of these units, the photosensitive member unit 10 comprises a photosensitive member 11, a charger 12, a static eliminator 13 and a cleaner 14. The developer unit 30 comprises a developing roller 31 and the like. Further, the transfer unit 40 comprises an intermediate transfer roller 41 and the like.

In the photosensitive member unit 10, the photosensitive member 11 is disposed for free rotations in the arrow direction 15 shown in FIG. 1 (i.e., in the clockwise direction in FIG. 1). Disposed around the photosensitive member 11 are the charger 12, the developing roller 31, the intermediate transfer roller 41, the static eliminator 13 and the cleaner 14 along the rotation direction 15 of the photosensitive member 11. A surface area between the charger 12 and a developing position 16 serves as an irradiation area of a light beam 21 from the exposure unit 20. The charger 12 is formed by a charger roller in this embodiment. Applied with an charging bias from a charging bias generator 111, the charger 12 uniformly charges an outer circumferential surface of the photosensitive member 11 to a predetermined surface potential Vd (e.g., Vd=DC+600 V), thus functioning as charging device.

The exposure unit 20 emits the light beam 21, which is laser for instance, toward the outer circumferential surface of the photosensitive member 11 which is uniformly charged by the charger 12. The exposure unit 20 exposes the photosensitive member 11 with the light beam 21 in accordance with a control instruction which is fed from an exposure controller 112, so as to form an electrostatic latent image which corresponds to an image signal on the photosensitive member 11, thus functioning as exposure device. For instance, when a print instruction signal containing an image signal is fed to a CPU 101 of the main controller 100 via an interface 102 from an external apparatus such as a host computer, in response to an instruction from the CPU 101 of the main controller 100, a CPU 113 outputs a control signal which corresponds to the image signal to the exposure controller 112 at predetermined timing. The exposure unit 20 then irradiates the light beam 21 upon the photosensitive member 11 in accordance with the control instruction received from the exposure controller 112, and an electrostatic latent image which corresponds to the image signal is formed on the photosensitive member 11. In this embodiment, the photosensitive member 11 corresponds to a "latent image carrier" of the present invention.

Thus formed electrostatic latent image is visualized with toner which is supplied by means of the developing roller 31 of the developer unit 30 (a development step). The developer unit 30 comprises, in addition to the developing roller 31, a tank 33 which stores liquid developer 32, a coating roller 34 which scoops up the liquid developer 32 stored in the tank 33 and supplies the liquid developer 32 to the developing roller 31, a restricting blade 35 which restricts the thickness of a layer of the liquid developer on the coating roller 34 into uniform thickness, a cleaning blade 36 which removes the liquid developer which remains on the developing roller 31 after the toner has been supplied to the photosensitive member 11, and a memory 37 (FIG. 3) which will be described later. The developing roller 31 rotates approximately at the same circumferential speed as the photosensitive member 11 in a direction which follows the photosensitive member 11 (the anti-clockwise direction in FIG. 1). On the other hand, the coating roller 34 rotates approximately at double the circumferential speed in the same direction as the developing roller 31 (i.e., in the anti-clockwise direction in FIG. 1).

The liquid developer 32 is obtained by dispersing, within carrier liquid, toner which is formed by a color pigment, an adhesive agent such as an epoxy resin which bonds the color pigment, an electric charge control agent which gives a predetermined charge to the toner, a dispersing agent which uniformly disperses the color pigment, etc. In this embodiment, silicone oil such as polydimethylsiloxane oil is used as the carrier liquid, and a toner density is 5 through 40 wt % which is a higher density than that of a low-density liquid developer which is often used in the liquid development process (and whose toner density is 1 through 2 wt %). The type of the carrier liquid is not limited to silicone oil, and the viscosity of the liquid developer 32 is determined by materials of the carrier liquid which are used and the toner, a toner density, etc. In this embodiment, the viscosity is 50 through 6000 mPa·s for example.

A gap between the photosensitive member 11 and the developing roller 31 (i.e., a development gap=the thickness of the liquid developer layer) is set to 5 through 40 μm for instance in this embodiment. A development nip distance (which is a distance along a circumferential direction over which the liquid developer layer contacts both the photosensitive member 11 and the developing roller 31) is set to 5 mm for instance in this embodiment. As compared with where the low-density liquid developer mentioned above is used and therefore a development gap of 100 through 200 μm is demanded so as to attain a toner amount, this embodiment which uses a high-density liquid developer allows to shorten the development gap. Since this in turn shortens a travel of toner which moves within the liquid developer because of electrophoresis and permits to develop a higher electric field even at the same developing bias, it is possible to improve the efficiency of development and develop at a high speed.

In the developer unit 30 having such a structure, the coating roller 34 scoops up the liquid developer 32 stored in the tank 33 and the restricting blade 35 restricts the thickness of the liquid developer layer on the coating roller 34 into uniform thickness. The uniform liquid developer 32 adheres to a surface of the developing roller 31, and as the developing roller 31 rotates, the liquid developer 32 is transported to the developing position 16 which is faced with the photosensitive member 11. The toner in the liquid developer is positively charged, for example, by the effect of the electric charge control agent and the like.

At the developing position 16, the liquid developer 32 carried on the developing roller 31 is supplied so as to adhere to the photosensitive member 11. Toner moves toward the photosensitive member 11 from the developing roller 31 because of a developing bias Vb (e.g., Vb=DC+400 V) which is applied upon the developing roller 31 by a developing bias generator 114, and an electrostatic latent image is accordingly visualized. On the other hand, the liquid developer not adhered to the photosensitive member 11 and remaining on the developing roller 31 is scraped off by the cleaning blade 36 and is returned back to the tank 33 by its own weight. Thus, in the first preferred embodiment, the tank 33 corresponds to a "container" of the present invention.

A toner image which is formed on the photosensitive member 11 in this fashion is transported to a primary transferring position 44 which faces the intermediate transfer roller 41, as the photosensitive member 11 rotates. The intermediate transfer roller 41 rotates approximately at the same circumferential speed as the photosensitive member 11 in a direction which follows the photosensitive member 11 (the anti-clockwise direction in FIG. 1). When a transferring bias generator 115 applies a primary transferring bias (which may be DC−400 V for instance), the toner image on the photosensitive member 11 is primarily transferred onto the intermediate transfer roller 41 (a transferring step). The static eliminator 13 formed by an LED or the like removes an electric charge remaining on the photosensitive member 11 after the primary transfer, and the cleaner 14 removes the liquid developer which remains. The cleaner 14 is constituted by scraping device such as a cleaning blade. Thus in the first preferred embodiment, the intermediate transfer roller 41 corresponds to a "transfer medium" of the present invention.

A secondary transfer roller 42 is disposed to face with an appropriate portion of the intermediate transfer roller 41 (right below the intermediate transfer roller 41 in FIG. 1). The primarily transferred toner image which has been primarily transferred onto the intermediate transfer roller 41 is transported to a secondary transferring position 45 facing the secondary transfer roller 42, as the intermediate transfer roller 41 rotates. Squeegee rollers 51, 52, 53 to be described hereinlater are disposed between the primary transferring position 44 and the secondary transferring position 45. Meanwhile, the transfer sheet 4 housed in the paper cassette 3 is transported to the secondary transferring position 45 by a transportation driver (not shown), in synchronization to the transportation of the primarily transferred toner image. The secondary transfer roller 42 rotates approximately at the same circumferential speed as the intermediate transfer roller 41 in a direction which follows the intermediate transfer roller 41 (the clockwise direction in FIG. 1). As the transferring bias generator 115 applies a secondary transferring bias (which may be −100 μA for example under constant current control) upon the secondary transfer roller 42, the toner image on the intermediate transfer roller 41 is secondarily transferred onto the transfer sheet 4. A cleaner 43 removes the liquid developer which remains on the intermediate transfer roller 41 after the secondary transfer. The transfer sheet 4 to which the toner image has been secondarily transferred in this manner is transported along a predetermined transfer paper transportation path 5 (denoted at the dashed line in FIG. 1), subjected to fixing of the toner image by a fixing unit 6, and discharged into a discharge tray which is disposed in an upper portion of the apparatus body 2. An operation display panel 7 comprising a liquid crystal display and a touch panel is disposed in a top surface of the apparatus body 2. The operation display panel 7 accepts an operation instruction from a user, and shows predetermined information to inform the user of the information.

Structures of the squeegee rollers 51, 52 and 53 will now be described. The squeegee rollers 51, 52 and 53 are disposed next to each other along the rotation direction (i.e., a direction in which the liquid developer is transported) 46 in such a manner that the squeegee rollers 51, 52 and 53 are faced against an area on the intermediate transfer roller 41 between the primary transferring position 44 and the secondary transferring position 45. The squeegee rollers 51, 52 and 53 are supported in such a manner that the squeegee rollers 51, 52 and 53 can move in a direction closer to and away from the intermediate transfer roller 41. In short, when a contacting/clearing driver 118 (FIG. 3) drives actuators 61, 62 and 63 (FIG. 3) which are formed by solenoids, motors or the like for instance, the squeegee rollers 51, 52 and 53 reciprocally move between contacting positions (denoted at the solid lines in FIG. 1) and clear-off positions (denoted at the broken lines in FIG. 1). The contacting positions are such positions at which the squeegee rollers 51, 52 and 53 contact the liquid developer which is carried on the intermediate transfer roller 41. The clear-off positions are such positions at which the squeegee rollers 51, 52 and 53 remain not in contact with the above-mentioned liquid developer.

Further, when a motor driver 119 (FIG. 3) drives roller driving motors 64 (FIG. 3) into rotations at the contacting positions, the squeegee rollers 51, 52 and 53 rotate approximately at the same circumferential speed as the intermediate transfer roller 41 in a direction which follows the intermediate transfer roller 41 (the clockwise direction in FIG. 1). When located at the contacting positions in contact with the carrier liquid which is in a surface layer of the liquid developer 32 which is carried on the intermediate transfer roller 41, the squeegee rollers 51, 52 and 53 strip the intermediate transfer roller 41 of the carrier liquid. The details of the carrier liquid stripping operation by the squeegee rollers 51, 52, 53 will be described hereinlater.

As shown in FIG. 2, cleaning blades 54 abut on the squeegee rollers 51, 52 and 53. The carrier liquid stripped off from the intermediate transfer roller 41 by the squeegee rollers 51, 52 and 53 is scraped off by the respective cleaning blades 54 and removed from the squeegee rollers 51, 52 and 53. A receiving tray 55 for collecting the carrier liquid is disposed at place under abutment positions for the cleaning blades 54 to abut against the respective squeegee rollers 51, 52, 53. Thus, the carrier liquid removed from the squeegee rollers 51 through 53 by means of the cleaning blades 54 is allowed to drop by gravity so as to be collected in the receiving tray 55 (a collecting step). The receiving tray 55 is communicated with the tank 33 via a pipe 56. The collected carrier liquid is returned back to the tank 33 via the pipe 56 by driving a carrier transporting driver (not shown) such as a pump. Thus in the first preferred embodiment, the receiving tray 55 corresponds to a "collecting portion" of the present invention, whereas the pipe 56 corresponds to a "communicating portion" of the present invention.

In FIG. 3, the main controller 100 comprises an image memory 103 which stores an image signal fed from an external apparatus via the interface 102. The CPU 101, when receiving via the interface 102 a print instruction signal which contains an image signal from an external apparatus, converts the signal into job data which are in an appropriate format to instruct the engine part 1 to operate, and sends the data to the engine controller 110.

A memory 116 of the engine controller 110 is formed by a ROM which stores a control program for the CPU 113 containing preset fixed data, a RAM which temporarily stores control data for the engine part 1, the result of a calculation performed by the CPU 113 and the like, etc. The CPU 113 stores within the memory 116 data regarding an image signal fed from an external apparatus via the CPU 101.

A memory 37 of the developer unit 30 is for storing data regarding a production lot of the developer unit 30, a history of use, characteristics of toner inside, a remaining amount of the liquid developer 32, a toner density, etc. The memory 37 is electrically connected with a communications part 38 which is attached to the tank 33 for example. The communications part 38 has such a structure that the communications part 38 comes faced with a communications part 117 of the engine controller 110 over a predetermined distance, which may be 10 mm for instance, or a shorter distance when the developer unit 30 is mounted to the apparatus body 2 and, is capable of sending data to and receiving data from the communications part 117 by a wireless communication such as one which uses an infrared ray while remaining not in contact with the communications part 117. The CPU 113 thus manages various types of information such as management of consumables related to the developer unit 30.

This embodiment requires to electromagnetic means such as a wireless communication for the purpose of attaining non-contact data transmission. An alternative however is to dispose one connector to each of the apparatus body 2 and the developer unit 30 and to mechanically engage the two connectors with each other by mounting the developer unit 30 to the apparatus body 2, whereby data transmission is realized between the apparatus body 2 and the developer unit 30. In addition, it is desirable that the memory 37 is a non-volatile memory which can save data even when a power source is off or the developer unit 30 is off the apparatus body 2. An EEPROM, such as a flash memory, a ferroelectric memory, or the like may be used as such a non-volatile memory.

Figure 4:
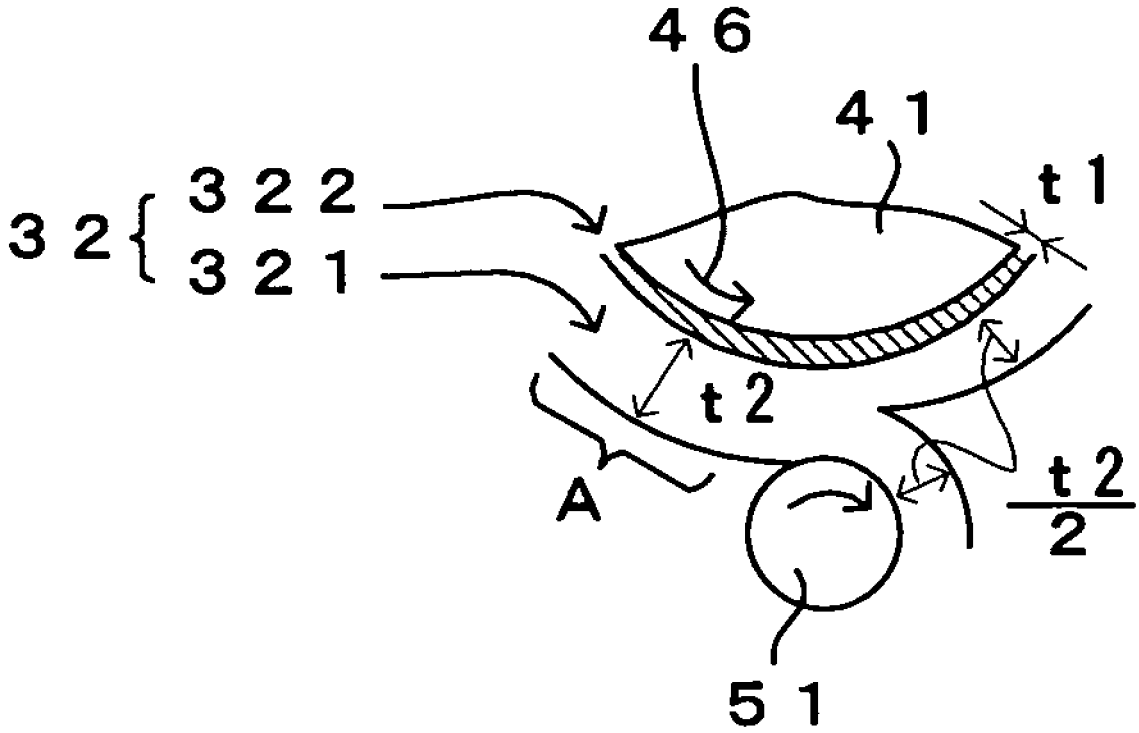
FIG. 4 is an explanatory view which shows a stripped amount of carrier liquid which is removed by a squeegee roller.

FIG. 4 is a drawing for describing an operation that the squeegee roller 51 strips the intermediate transfer roller 41 of the carrier liquid. In FIG. 4, in an area A, that is, on the upstream side to the squeegee roller 51 along the rotation direction 46 of the intermediate transfer roller 41, the liquid developer 32 is supplied from the photosensitive member 11 (FIG. 1) and adheres to the intermediate transfer roller 41, toner image 322 (which is a solid black image in FIG. 4) moves within carrier liquid 321 owing to the transferring bias and is transferred onto the intermediate transfer roller 41. The toner image 322 has thickness of t1, and the carrier liquid 321 has thickness of t2. In short, the thickness of the liquid developer 32 on the intermediate transfer roller 41 is (t1+t2).

The liquid developer 32 on the intermediate transfer roller 41 is nipped between the squeegee roller 51 which is located at the contacting position and the intermediate transfer roller 41, and the carrier liquid 321 which is in the surface layer of the liquid developer 32 comes into contact with the squeegee roller 51 and adheres to the squeegee roller 51. As the squeegee roller 51 and the intermediate transfer roller 41 rotate, the carrier liquid 321 gets separated approximately at the center of the carrier liquid 321. In other words, the thickness of the carrier liquid 321 which remains on the intermediate transfer roller 41 and the thickness of the carrier liquid 321 which moves to the squeegee roller 51 each become about t2/2.

The squeegee roller 51 takes away a portion of the carrier liquid 321 off from the intermediate transfer roller 41 in this manner. This embodiment uses the three squeegee rollers 51 through 53 which can move to the contacting positions and the clear-off positions, and the CPU 113 controls the positions of the squeegee rollers 51 through 53. When a combination of the squeegee rollers 51 through 53 which are moved to the contacting positions is controlled, a stripped amount of the carrier liquid 321 is controlled and a collection amount of the carrier liquid 321 is consequently adjusted. In this embodiment, the squeegee rollers 51 through 53 thus each correspond to the "stripping member" and "collecting device" of the present invention.

FIGS. 5A through 8D are drawings for describing a relationship between an image occupation ratio and a stripped amount of the carrier liquid. FIGS. 5A, 6A, 7A and 8A show toner images on the intermediate transfer roller 41, FIGS. 5B, 6B, 7B and 8B show a position at which the squeegee roller 51 is located, FIGS. 5C, 6C, 7C and 8C show a position at which the squeegee roller 52 is located, and FIGS. 5D, 6D, 7D and 8D show a position at which the squeegee roller 53 is located. In FIGS. 5A through 8D, the squeegee rollers at the contacting positions are denoted at the solid lines but those at the clear-off positions are denoted at the broken lines as in FIG. 19. Further, the intermediate transfer roller 41 is shown as a flat plate for the convenience of illustration.

An image occupation ratio is a ratio of an image portion to an electrostatic latent image. The main controller 100 (FIG. 3) comprises a dot counter which counts an on-dot count which represents the number of pixels to which toner adheres among pixels which form an electrostatic latent image for example, and therefore, is equipped with a function of calculating, as an image occupation ratio, a ratio of an on-dot count to a dot count of an image as a whole. For instance, the image occupation ratio of a solid black image is 100% but is 0% in a solid white portion within an image (e.g., a blank portion within an image). Instead of the main controller 100, the engine controller 110 (FIG. 3) may comprise the dot counter.

Although the liquid developer 32 stored in the tank 33 is a high-density liquid developer whose density is in the range from 5 to 40 wt % in this embodiment as described earlier, the toner density in the liquid developer 32 is set to 20% by volume (an initial value of the toner density) for instance which is a value within the above-mentioned toner density range. In addition, the thickness t1 of the toner image 322 which adheres to the intermediate transfer roller 41 during development is 2 μm and the thickness t2 of the carrier liquid 321 is 8 μm in FIG. 4. That is, the thickness (t1+t2) of the liquid developer 32 on the intermediate transfer roller 41 is 10 μm.

Figure 5A:
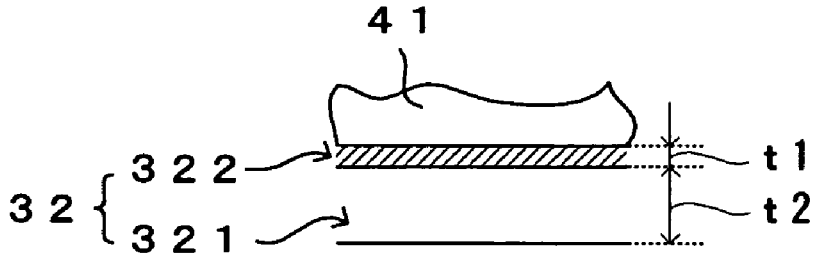
FIGS. 5A through 5D are drawings for describing a relationship between an image occupation ratio and a stripped amount of a carrier liquid.
Figure 5B:
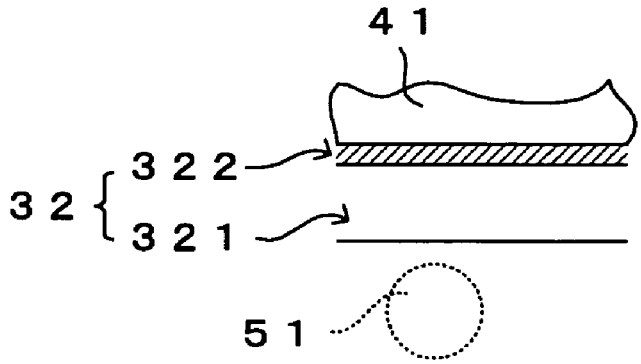
Figure 5C:
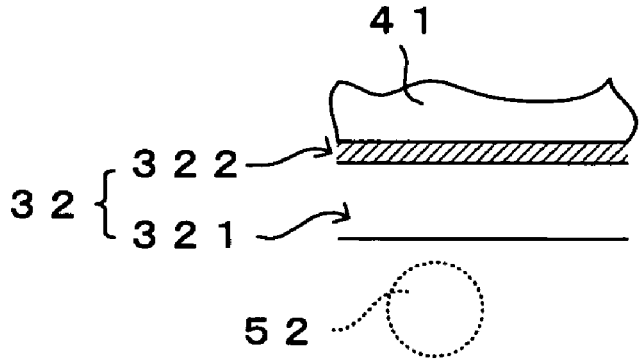
Figure 5D:
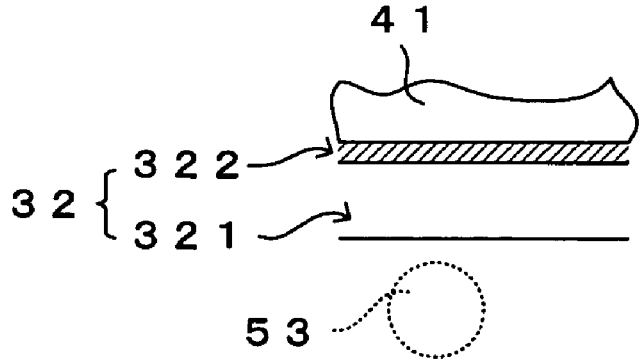

FIGS. 5A through 5D represent an example that an image occupation ratio is 100% (solid black image) as shown in FIG. 5A. In this case, the toner density in the liquid developer 32 which is on the intermediate transfer roller 41 is 20% by volume (vol %) which is the same as the initial value of the toner density within the tank 33. Noting this, the squeegee rollers 51 through 53 are all moved to the clear-off positions as shown in FIGS. 5B through 5D, so as not to collect the carrier liquid 321. In short, a collection amount of the carrier liquid 321 is zero. Although this makes the liquid developer 32 on the intermediate transfer roller 41 all consumed, since the toner density of thus consumed liquid developer is equal to the initial value of the liquid developer 32 of the toner density within the tank 33, the toner density within the tank 33 is maintained at the initial value of 20 vol %.

Figure 6A:
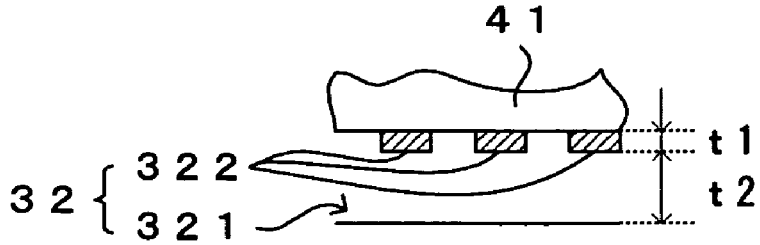
FIGS. 6A through 6D are drawings for describing a relationship between an image occupation ratio and a stripped amount of a carrier liquid.

FIGS. 6A through 6D represent an example that an image occupation ratio is 50% as shown in FIG. 6A for instance. In this case, the toner density in the liquid developer 32 which is on the intermediate transfer roller 41 is 10 vol %, t1=2 μm and t2=8 μm hold truth. However, the thickness of the toner image 322 on the average is 1 μm and the thickness of the carrier liquid 321 on the average is 9 μm. This means that more carrier liquid has moved to the intermediate transfer roller 41 as compared with the example shown in FIGS. 5A through 5D.

Figure 6B:
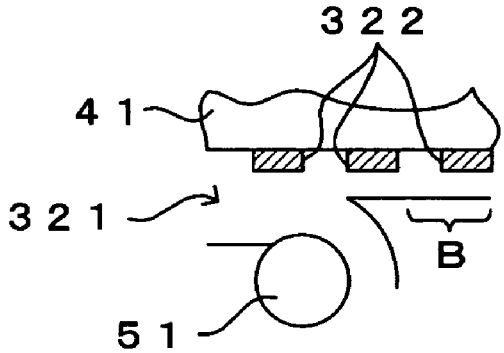

Noting this, the squeegee roller 51 is moved to the contacting position as shown in FIG. 6B, thereby stripping off approximately half the carrier liquid 321 which is in the surface layer. As a result, the thickness of the carrier liquid 321 on the average which remains in an area B in FIG. 6B, namely, the intermediate transfer roller 41 is about 4.5 μM. The toner density in the liquid developer 32 within the area B is therefore about 18 vol % which is approximately equal to the toner density inside the tank 33.

Figure 6C:
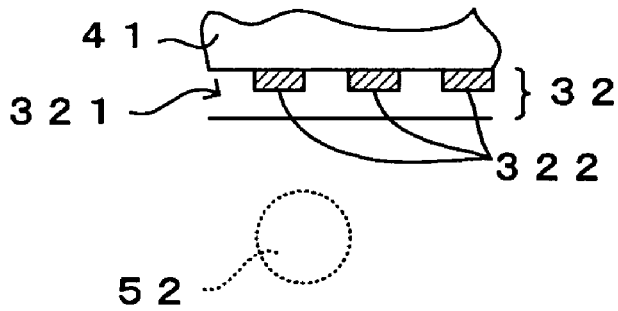
Figure 6D:
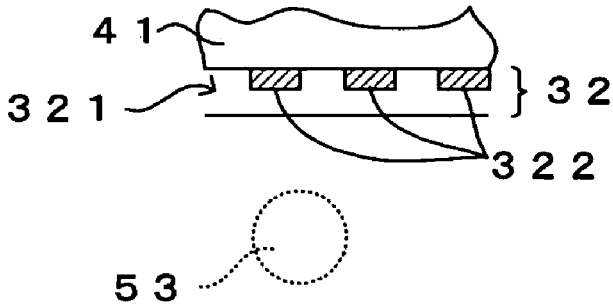

With the squeegee rollers 52 and 53 located at the clear-off positions as shown in FIGS. 6C and 6D, the toner density in the liquid developer 32 which remains on the intermediate transfer roller 41 is maintained at about 18 vol %. In addition, although the toner density inside the tank 33 rose upon movement of a great amount of the carrier liquid 321 to the intermediate transfer roller 41, the carrier liquid 321 taken away by the squeegee roller 51 is returned to the tank 33, the toner density inside the tank 33 decreases and becomes close to 20 vol % which is the initial value.

Figure 7A:
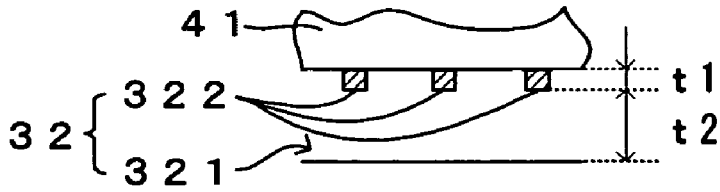
FIGS. 7A through 7D are drawings for describing a relationship between an image occupation ratio and a stripped amount of a carrier liquid.

FIGS. 7A through 7D represent an example that an image occupation ratio is 20% as shown in FIG. 7A. In this case, the toner density in the liquid developer 32 which is on the intermediate transfer roller 41 is 4 vol %, t1=2 μm and t2=8 μm hold truth. However, the thickness of the toner image 322 on the average is 0.4 μm and the thickness of the carrier liquid 321 on the average is 9.6 μm. This means that more carrier liquid has moved to the intermediate transfer roller 41 as compared with the example shown in FIGS. 6A through 6D.

Figure 7B:
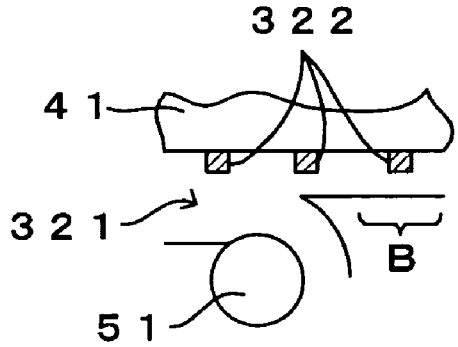
Figure 7C:
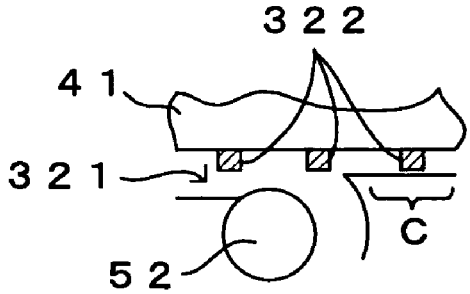
Figure 7D:
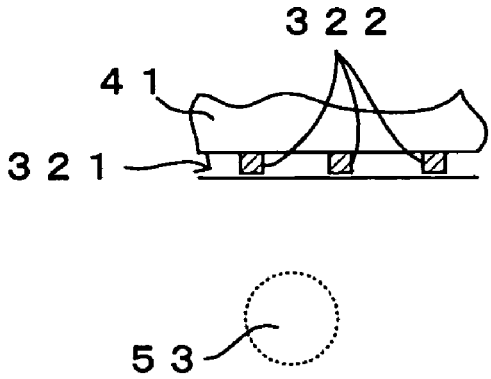

Noting this, the squeegee roller 51 is moved to the contacting position as shown in FIG. 7B, thereby stripping off approximately half the carrier liquid 321 which is in the surface layer. As a result, the thickness of the carrier liquid 321 on the average which remains on the intermediate transfer roller 41 within an area B in FIG. 7B is about 4.8 μm and the toner density in the liquid developer 32 which is within the area B is about 7.7 vol %. Further, as shown in FIG. 7C, when the squeegee roller 52 is moved to the contacting position, thereby stripping off approximately half the carrier liquid 321 which is in the surface layer. In consequence, the thickness of the carrier liquid 321 on the average which remains on the intermediate transfer roller 41 within an area C in FIG. 7C is about 2.4 μM. Hence, the toner density in the liquid developer 32 which is within the area C is about 14 vol %, thus becoming close to the toner density inside the tank 33. The squeegee roller 53 however is located at the clear-off position as shown in FIG. 7D and therefore does not take away the carrier liquid 321. This is because further stripping off of the carrier liquid 321 could adversely affect a toner image on the intermediate transfer roller 41.

Hence, the toner density in the liquid developer 32 which remains on the intermediate transfer roller 41 is about 14 vol %. Meanwhile, although the toner density inside the tank 33 rises upon movement of a great amount of the carrier liquid 321 to the intermediate transfer roller 41, the toner density inside the tank 33 decreases and becomes close to 20 vol % which is the initial value as the carrier liquid 321 taken away by the squeegee rollers 51 and 52 is returned back to the tank 33.

Figure 8A:
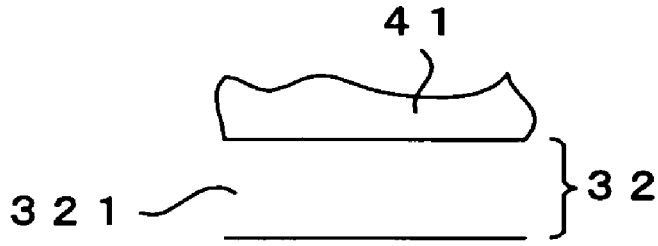
FIGS. 8A through 8D are drawings for describing a relationship between an image occupation ratio and a stripped amount of a carrier liquid.
Figure 8B:
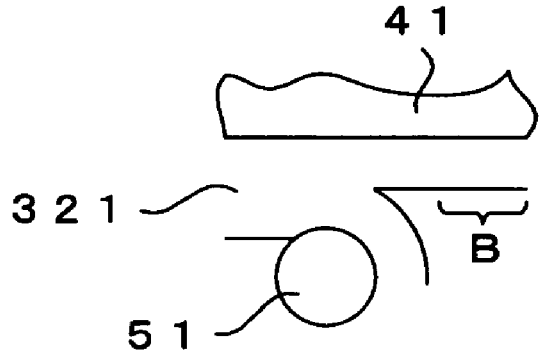
Figure 8C:
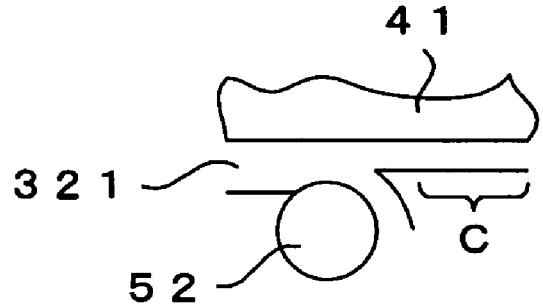
Figure 8D:
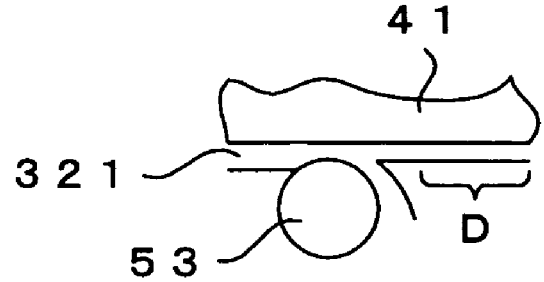

FIGS. 8A through 8D represent an example that an image occupation ratio is 0% (solid white image) as shown in FIG. 8A. In this case, the toner density in the liquid developer 32 which is on the intermediate transfer roller 41 is 0 vol %, the carrier liquid 321 alone is consumed and the toner density inside the tank 33 increases. Noting this, as shown in FIGS. 8B through 8D, the squeegee rollers 51 through 53 are all moved to the contacting positions, thereby collecting the carrier liquid 321. The thickness within the area B after the stripping by the squeegee roller 51 is therefore about 5 μm, the thickness within the area C after the stripping by the squeegee roller 52 is about 2.5 μm, and the thickness within the area D after the stripping by the squeegee roller 53 is about 1.25 μm. As the carrier liquid 321 taken away by the respective squeegee rollers 51 through 53 is returned to the tank 33, an increase of the toner density inside the tank 33 is suppressed.

As described above, by controlling the positions of the squeegee rollers 51 through 53, a stripped amount of the carrier liquid 321 stripped off from the intermediate transfer roller 41 is controlled. Hence, by controlling the positions of the squeegee rollers 51 through 53, it is possible to adjust the toner density of the liquid developer 32 on the intermediate transfer roller 41. Accordingly, the transfer conditions under which the image is transferred to the recording medium such as the transfer sheet are prevented from changing and hence, a good image quality may be achieved.

Figure 9:
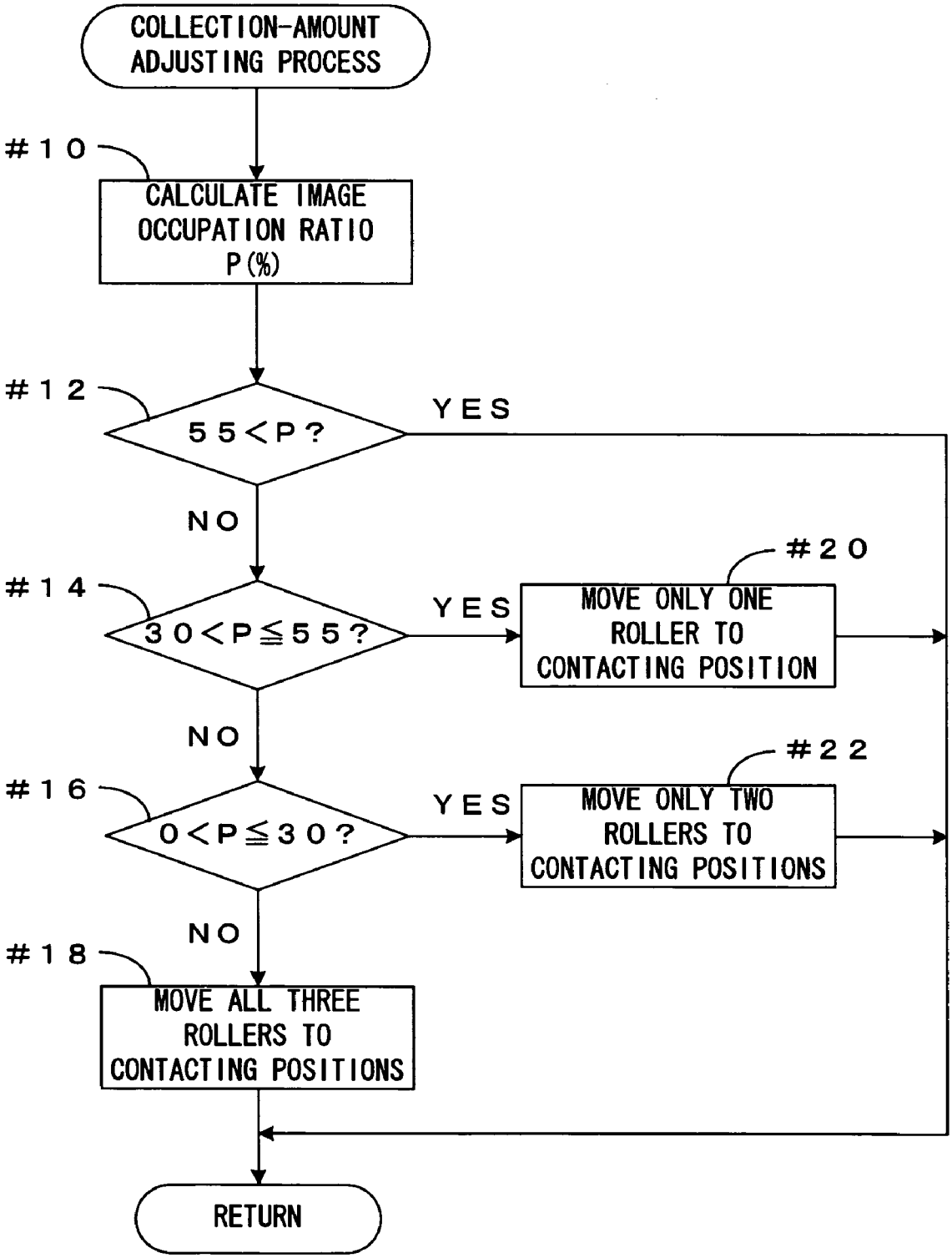
FIG. 9 is a flow chart showing an example of a collection-amount adjusting process routine.

FIG. 9 is a flow chart which shows an example of a collection amount adjusting process routine. A collection amount adjusting process program is stored in advance in the memory 116 of the engine controller 110. As the CPU 113 controls the respective portions of the apparatus in accordance with the program, the following collection amount adjusting process is executed.

First, an image occupation ratio P (%) which is a ratio of an image portion to an electrostatic latent image is calculated (#10), and the level of the calculated image occupation ratio is judged. That is, whether 55<P holds truth is determined (#12). When P≦55 holds truth (NO at #12), whether 30<P≦55 is determined (#14). When P≦30 holds truth (NO at #14), whether 0<P≦30 is determined (#16). Since P=0 holds truth when NO at #16, as described with reference to FIGS. 8A through 8D, the squeegee rollers 51 through 53 are all moved to the contacting positions (#18).

When 55<P holds truth (YES at #12), this means that the toner density on the intermediate transfer roller 41 is high. Therefore, as described with reference to FIGS. 23A through 23D, this routine is terminated with the squeegee rollers 51 through 53 all kept at the clear-off positions. When 30<P≦55 holds truth (YES at #14), since this means that the toner density on the intermediate transfer roller 41 is medium, the squeegee roller 51 for example is moved to the contacting position (#20) as described with reference to FIGS. 6A through 6D. Only one roller may be moved at this stage. Therefore, the squeegee roller 52 or 53 may be moved instead of the squeegee roller 51.

When 0<P≦30 holds truth (YES at #16), this means that the toner density on the intermediate transfer roller 41 is low. Therefore, as described with reference to FIGS. 7A through 7D, the squeegee rollers 51 and 52 for example are moved to the contacting positions (#22). Since two rollers may be moved at this stage, the squeegee rollers 51 and 53 or the squeegee rollers 52 and 53 may be moved. The threshold values used to determine the level of the image occupation ratio at the steps #12, #14 and #16 are merely examples, and other values may be used instead.

Figure 10:
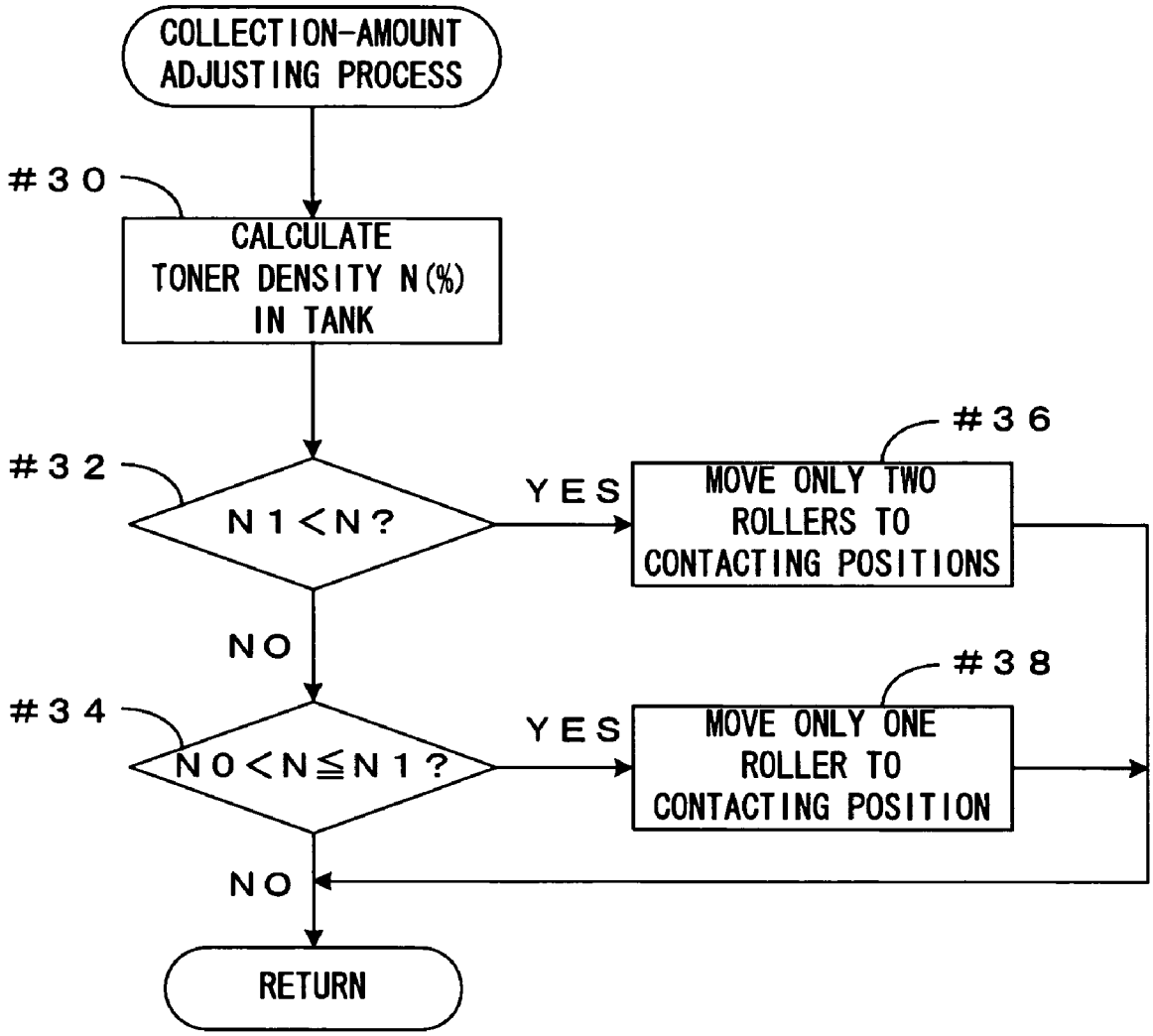
FIG. 10 is a flow chart showing other example of the collection-amount adjusting process routine.

FIG. 10 is a flow chart which shows other example of the collection amount adjusting process routine. During operations according to the illustrated example, the developer unit 30 comprises a viscometer 39 as denoted at the broken lines in FIG. 3. The viscometer 39 is disposed inside the tank 33, and the CPU 113 calculates a toner density based on the viscosity of the liquid developer 32 which is detected by the viscometer 39. Instead of the viscometer 39, a density sensor formed by a transmission-type optical sensor for example may be disposed inside the tank 33 and the sensor itself may detect the toner density in the liquid developer 32 which is within the tank 33. In this embodiment, the viscometer 39 thus corresponds to the "density detecting device" of the present invention.

First, the toner density N (%) in the liquid developer 32 which is within the tank 33 is calculated based on a detection signal obtained by the viscometer 39 (#30). A relationship between the viscosity of the liquid developer 32 which is detected by the viscometer 39 and the toner density in the liquid developer 32 is identified in the form of an arithmetic expression or table data in advance and contained in the program which is stored in the memory 116. The processing of calculating the toner density at #30 is executed based on the relationship described above.

Whether thus calculated toner density is N1<N is determined (#32). When N≦N1 holds truth (NO at #32), whether N0<N≦N1 is determined (#34). When N≦N0 holds truth (NO at #32), since this means that the toner density has dropped, this routine is terminated without collecting the carrier liquid. N0 is an initial value of the toner density in the liquid developer 32 which is within the tank 33, and N1 is a value which is calculated through experiments or the like in advance and satisfies the relationship N0<N1.

On the other hand, when N1<N holds truth (YES at #32), since this means that the toner density has largely increased, the squeegee rollers 51 and 52 for example are moved to the contacting positions (#36) as described with reference to FIGS. 25A through 25D. Since two rollers may be moved at this stage, the squeegee rollers 51 and 53 or the squeegee rollers 52 and 53 may be moved to the contacting positions.

Further, when N0<N≦N1 holds truth (YES at #34), the toner density has just slightly increased. Therefore, the squeegee roller 51 for instance is moved to the contacting position (#38) as described with reference to FIGS. 24A through 24D. Since only one roller may be moved at this stage, the squeegee roller 52 or 53 may be moved to the contacting position instead of the squeegee roller 51.

Alternatively, values of the viscosity of the liquid developer 32 which correspond to comparison values of the toner density in the liquid developer 32 (N0 and N1 in FIG. 10) may be identified and stored in the memory 116 in advance based on the relationship between the viscosity of the liquid developer 32 which is detected by the viscometer 39 and the toner density in the liquid developer 32, and the detected viscosity may be compared with a corresponding value directly, to thereby make the judgments at the steps #32 and #34 in FIG. 10.

As described above, the first preferred embodiment uses the squeegee rollers 51 through 53 which can move to the contacting positions which are in contact with the liquid developer 32 which is on the intermediate transfer roller 41 and the clear-off positions which are not in contact with the liquid developer 32 which is on the intermediate transfer roller 41, and a combination of the squeegee rollers 51 through 53 which are moved to the contacting positions is controlled. Hence, it is possible to control a stripped amount of the carrier liquid 321 which is stripped off from the intermediate transfer roller 41. This permits to adjust a collection amount of the carrier liquid 321 which is collected from the intermediate transfer roller 41. Since the carrier liquid 321 which has been taken away by the squeegee rollers 51 through 53 is all scraped off by the cleaning blades 54 and returned back to the tank 33, it is possible through the collection amount adjustment described above to adjust the amount of the carrier liquid 321 which is returned back to the tank 33. Therefore, the embodiment can suppress the fluctuations of the toner density in the liquid developer 32 in the tank 33. Thus, the development process for visualizing the electrostatic latent image on the photosensitive member 11 may be prevented from suffering a degraded development quality. As a result, it is ensured that favorable images are obtained in a reliable manner.

According to the embodiment, the carrier liquid 321, as scraped off from the squeegee rollers 51 through 53 by means of the cleaning blades 54, is allowed to drop by gravity to be collected by the receiving tray 55 and then, is returned to the tank 33. Thus, the embodiments negates the need for the provision of an additional device for transporting the carrier liquid 321, collected from the squeegee rollers 51 through 53, to the receiving tray 55. This leads to a simplified apparatus construction. Further, as thus stripped carrier liquid 321 is returned back to the tank 33, it is possible to make an effective use of the carrier liquid 321 and minimize the amount of the carrier liquid 321 which is replenished.

During the operations shown in FIG. 9, an image occupation ratio is calculated, a stripped amount of the carrier liquid 321 is controlled such that the toner density in the liquid developer 32 which remains on the intermediate transfer roller 41 after collection will be close to the initial value of the toner density in the liquid developer 32 which is within the tank 33, and the carrier liquid 321 taken away by the squeegee rollers 51 through 53 is all scraped off by the cleaning blades 54 and returned back to the tank 33. Hence, it is possible to suppress a toner density change in the liquid developer 32 inside the tank 33 and maintain the toner density at the initial value. This permits to use the liquid developer 32 stored in the tank 33 to the very end without wasting, and minimizes the amount of a carrier liquid, toner or the like replenished from outside. In the case of the operations shown in FIG. 9, since the toner density detecting device, such as the viscometer 39, of the tank 33 is not needed, there is an advantage that it is possible to simplify the structure of the apparatus as compared with the example shown in FIG. 10.

Further, during the operations shown in FIG. 10, the toner density inside the tank 33 is calculated based on a detection value obtained by the viscometer 39, a stripped amount of the carrier liquid which has been stripped off from the intermediate transfer roller 41 is controlled based on the detection value, and thus stripped carrier liquid is returned to the tank 33. Hence, it is possible to suppress a toner density change within the tank 33 and maintain the toner density at the initial value. This permits to use the liquid developer 32 stored in the tank 33 to the very end without wasting, and minimizes the amount of a carrier liquid, toner or the like replenished from outside.

Second Preferred Embodiment

Figure 11:
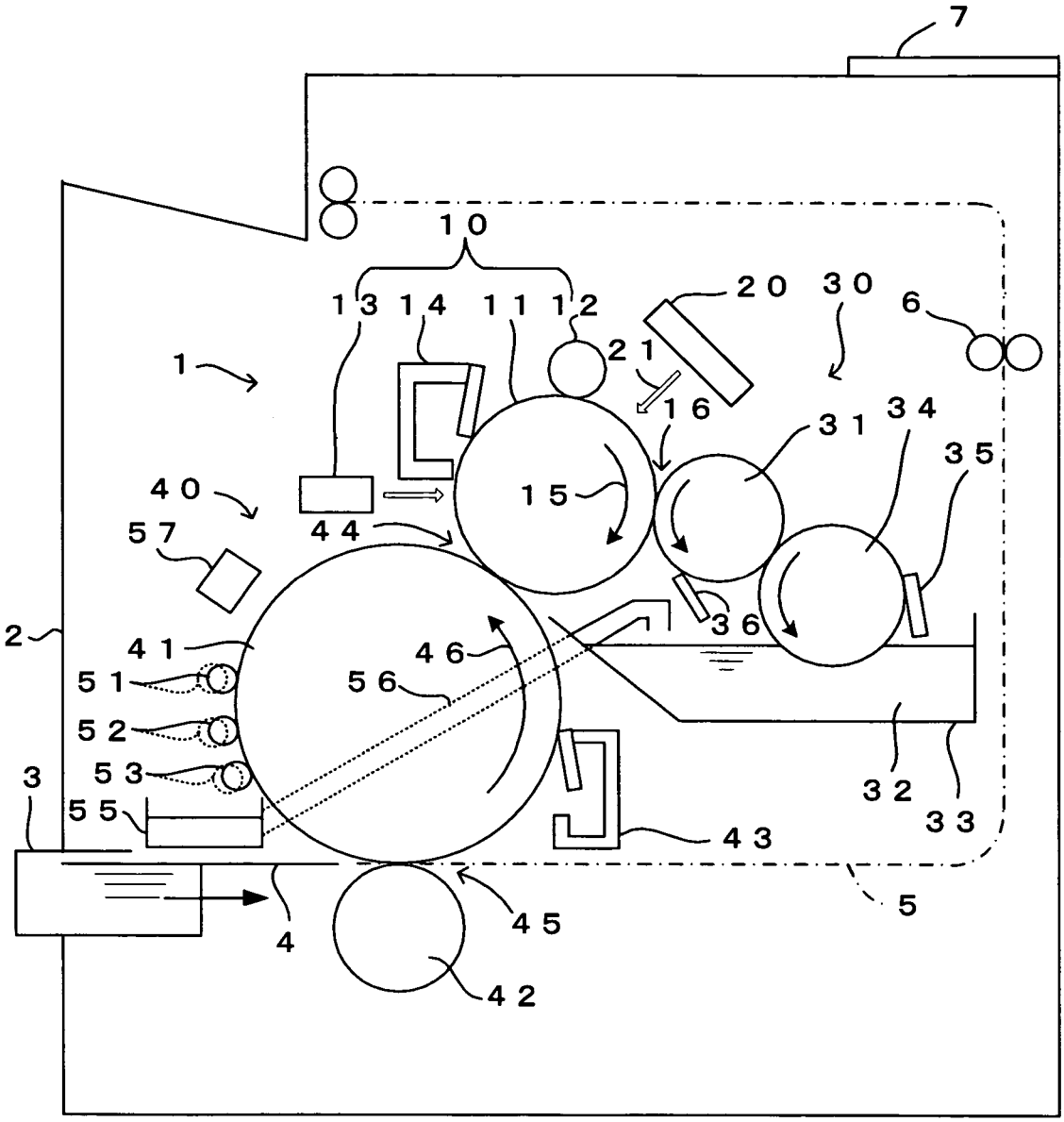
FIG. 11 is a drawing which shows an internal structure of a printer which is a second preferred embodiment of the present invention.
Figure 12:
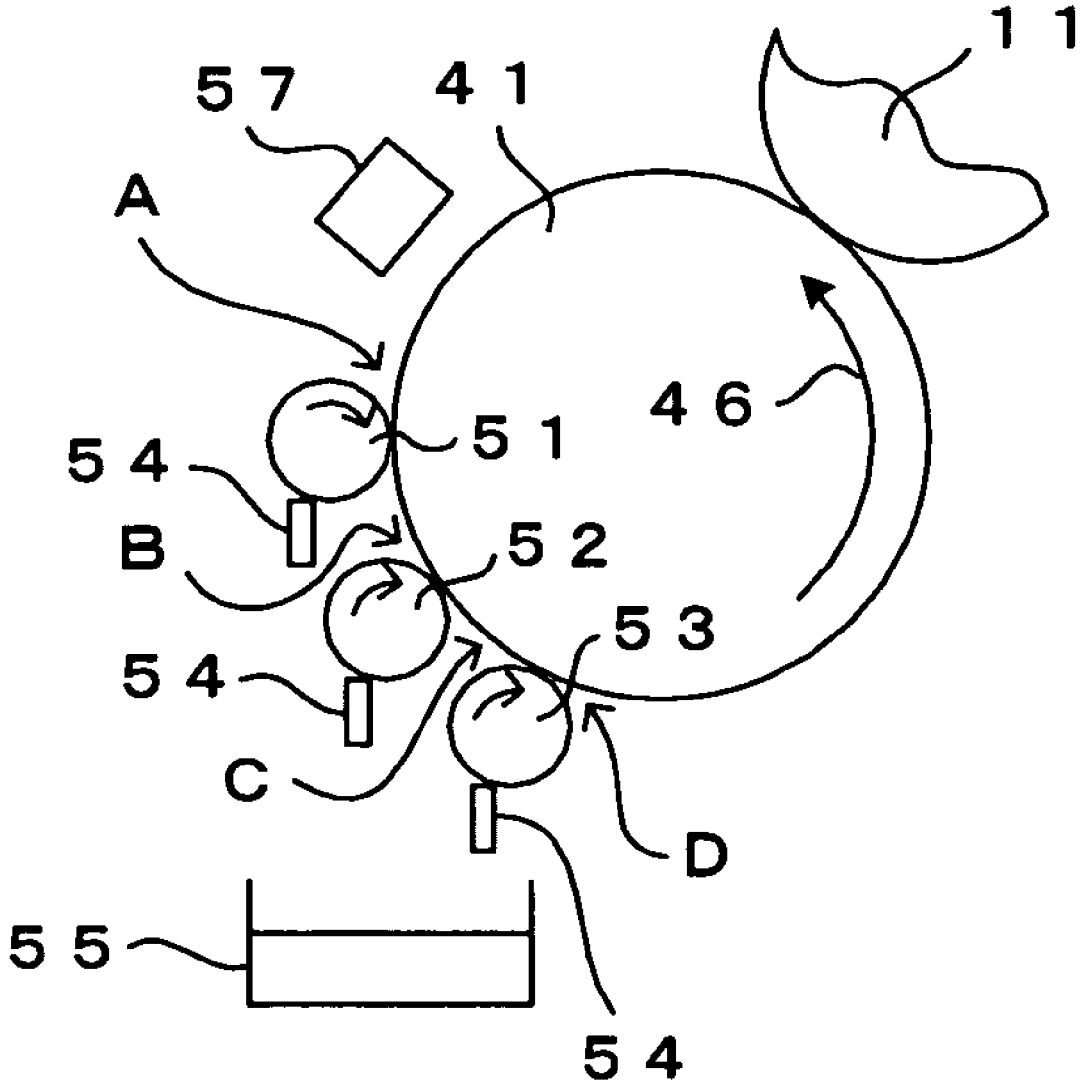
FIG. 12 is an enlarged view of a principal part of FIG. 11.

FIG. 11 is a drawing which shows an internal structure of a printer as an image forming apparatus according to a second preferred embodiment of the present invention, and FIG. 12 is an enlarged view of a principal part of FIG. 11. The second preferred embodiment principally differs from the first preferred embodiment in that the intermediate transfer roller 41 constitutes an "intermediate transfer medium" of the present invention and that the squeegee rollers 51, 52, 53 and a carrier dispenser 57 are disposed between the primary transferring position 44 and the secondary transferring position 45 and operate as "adjusting device" which adjust an amount of carrier liquid contained in the liquid developer 32 adherent to the intermediate transfer roller 41. The other parts are basically structured the same way as in the first preferred embodiment and hence, the same elements as those according to the first preferred embodiment are denoted at the same reference symbols, and will not be described. The following description is made on the features of the second preferred embodiment, focusing on the differences from the first preferred embodiment.

According to the second preferred embodiment, the toner image which is formed on the photosensitive member 11 is transported to a primary transferring position 44 which faces the intermediate transfer roller 41, as the photosensitive member 11 rotates. The intermediate transfer roller 41 rotates approximately at the same circumferential speed as the photosensitive member 11 in a direction which follows the photosensitive member 11 (the anti-clockwise direction in FIG. 11). When a transferring bias generator 115 applies a primary transferring bias (which may be DC−400 V for instance), the toner image on the photosensitive member 11 is primarily transferred onto the intermediate transfer roller 41 (a primary transferring step). The static eliminator 13 formed by an LED or the like removes an electric charge remaining on the photosensitive member 11 after the primary transfer, and the cleaner 14 removes the liquid developer which remains. The cleaner 14 is constituted by scraping device such as a cleaning blade. Thus in the second preferred embodiment, the intermediate transfer roller 41 corresponds to a "intermediate transfer medium" of the present invention.

The secondary transfer roller 42 is disposed to face with an appropriate portion of the intermediate transfer roller 41 (right below the intermediate transfer roller 41 in FIG. 11). The primarily transferred toner image which has been primarily transferred onto the intermediate transfer roller 41 is transported to a secondary transferring position 45 facing the secondary transfer roller 42, as the intermediate transfer roller 41 rotates. Squeegee rollers 51, 52, 53 and a carrier dispenser 57 to be described hereinlater are disposed between the primary transferring position 44 and the secondary transferring position 45. Meanwhile, the transfer sheet 4 (corresponding to a "recording medium" of the present invention) housed in the paper cassette 3 is transported to the secondary transferring position 45 by a transportation driver (not shown), in synchronization to the transportation of the primarily transferred toner image. The secondary transfer roller 42 rotates approximately at the same circumferential speed as the intermediate transfer roller 41 in a direction which follows the intermediate transfer roller 41 (the clockwise direction in FIG. 11). As the transferring bias generator 115 applies a secondary transferring bias (which may be −100 μA for example under constant current control) upon the secondary transfer roller 42, the toner image on the intermediate transfer roller 41 is secondarily transferred onto the transfer sheet 4 (a secondary transferring step). The cleaner 43 removes the liquid developer which remains on the intermediate transfer roller 41 after the secondary transfer. The transfer sheet 4 to which the toner image has been secondarily transferred in this manner is transported along a predetermined transfer paper transportation path 5 (denoted at the dashed line in FIG. 11), subjected to fixing of the toner image by a fixing unit 6, and discharged into a discharge tray which is disposed in an upper portion of the apparatus body 2. An operation display panel 7 comprising a liquid crystal display and a touch panel is disposed in a top surface of the apparatus body 2. The operation display panel 7 accepts an operation instruction from a user, and shows predetermined information to inform the user of the information.

In the second preferred embodiment, the amount of carrier liquid contained in the liquid developer 32 on the intermediate transfer roller 41 is adjusted by the above-mentioned adjusting device before the toner image on the intermediate transfer roller 41 is secondarily transferred to the transfer sheet 4. Specifically, in a case where it is desired to decrease the amount of carrier liquid contained in the liquid developer 32 on the intermediate transfer roller 41, a required amount of carrier liquid is taken away from the liquid developer on the intermediate transfer roller 41 by means of the squeegee rollers 51, 52, 53. In a case where it is desired to increase the amount of carrier liquid contained in the liquid developer 32 on the intermediate transfer roller 41, on the other hand, a required amount of carrier liquid is supplied to the liquid developer on the intermediate transfer roller 41 by means of the carrier dispenser 57. The "adjusting device" according to the second preferred embodiment will be described as below.

According to the second preferred embodiment, the squeegee rollers 51 through 53 each constitute the "stripping member" and the "adjusting device" of the present invention. The structure and operation of these squeegee rollers 51 through 53 are the same as those of the squeegee rollers 51 through 53 of the first preferred embodiment which serve as the "stripping member" and "collecting device" of the present invention described with reference to FIG. 4 and FIGS. 5A through 8D. Therefore, the description of the structure and operation is dispensed with. Similarly to the first preferred embodiment, the squeegee rollers 51 through 53 are so controlled as to adjust the amount of carrier liquid contained in the liquid developer 32 on the intermediate transfer roller 41.

Next, the structure of the carrier dispenser 57 is described. The carrier dispenser 57 is disposed facing against an area on the intermediate transfer roller 41 between the primary transferring position 44 and the secondary transferring position 45. The carrier dispenser 57 operates to supply an arbitrary amount of carrier liquid onto the intermediate transfer roller 41. The carrier dispenser 57 is structured, for example, with a carrier liquid source such as a tank which stores the carrier liquid therein and a carrier liquid supplying device such as a supplying roller which scoops up the carrier liquid stored in the tank and supplies the carrier liquid onto the intermediate transfer roller 41. Similarly to the squeegee rollers 51 through 53, the supplying roller is supported in such a manner that the supplying roller can move in a direction closer to and away from the intermediate transfer roller 41. When supplying the carrier liquid, the supplying roller may be positioned at a contacting position to contact the intermediate transfer roller 41. Whereas, when the carrier liquid is not supplied, the supplying roller may be retreated to a clear-off position to stay away from the intermediate transfer roller 41. When the carrier liquid is supplied, the supplying amount of carrier liquid is adjusted by, for example, controlling the rotational speed of the supplying roller. According to the embodiment, the carrier dispenser 57 corresponds to a "dispensing member" and "adjusting device" of the present invention.

It is noted that the structure of the carrier dispenser 57 is not limited to this. For instance, an arrangement may be made wherein a supplying nozzle, as the carrier liquid supplying device, is disposed at place upwardly of the intermediate transfer roller 41 for ejecting the carrier liquid onto the intermediate transfer roller 41. In this case, the amount of supplied carrier liquid may be adjusted by controlling the ejection volume.

Figure 13:
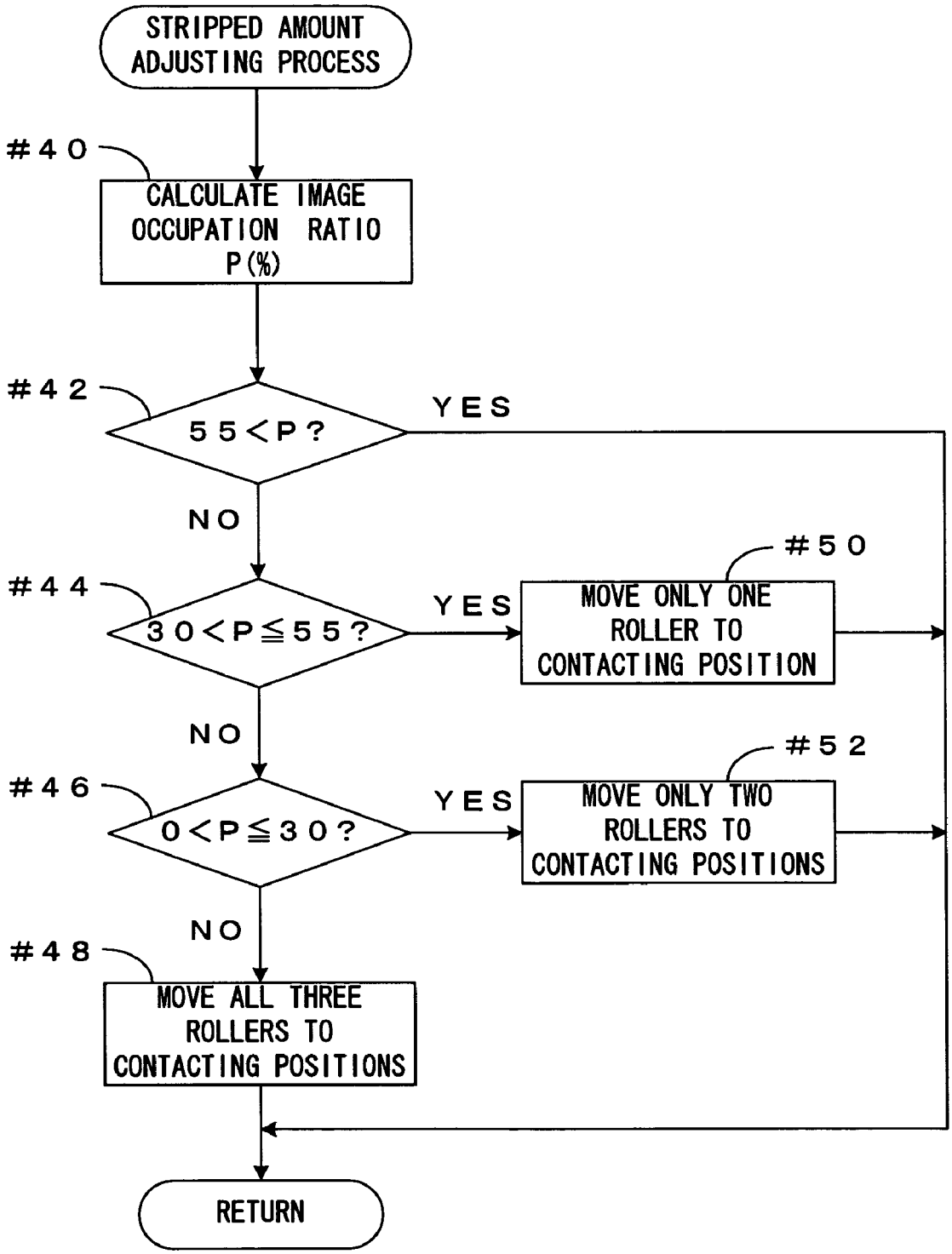
FIG. 13 is a flow chart showing an example of a stripped amount adjusting process routine.

FIG. 13 is a flow chart which shows an example of a stripped amount adjusting process routine. A stripped amount adjusting process program is stored in advance in the memory 116 of the engine controller 110. As the CPU 113 controls the respective portions of the apparatus in accordance with the program, the following stripped amount adjusting process is executed.

First, an image occupation ratio P (%) which is a ratio of an image portion to an electrostatic latent image is calculated (#40), and the level of the calculated image occupation ratio is judged. That is, whether 55<P holds truth is determined (#42). When P≦55 holds truth (N0 at #42), whether 30<P≦55 is determined (#44). When P≦30 holds truth (NO at #44), whether 0<P≦30 is determined (#46). Since P=0 holds truth when NO at #46, as described with reference to FIGS. 8A through 8D, the squeegee rollers 51 through 53 are all moved to the contacting positions (#48).

When 55<P holds truth (YES at #42), this means that the toner density on the photosensitive member 11 is high. Therefore, as described with reference to FIGS. 5A through 5D, this routine is terminated with the squeegee rollers 51 through 53 all kept at the clear-off positions. When 30<P≦55 holds truth (YES at #44), since this means that the toner density on the photosensitive member 11 is medium, the squeegee roller 51 for example is moved to the contacting position (#120) as described with reference to FIGS. 6A through 6D. Only one roller may be moved at this stage. Therefore, the squeegee roller 52 or 53 may be moved instead of the squeegee roller 51.

When 0<P≦30 holds truth (YES at #46), this means that the toner density on the photosensitive member 11 is low. Therefore, as described with reference to FIGS. 7A through 7D, the squeegee rollers 51 and 52 for example are moved to the contacting positions (#122). Since two rollers may be moved at this stage, the squeegee rollers 51 and 53 or the squeegee rollers 52 and 53 may be moved. The threshold values used to determine the level of the image occupation ratio at the steps #42, #44 and #46 are merely examples, and other values may be used instead.

Figure 14:
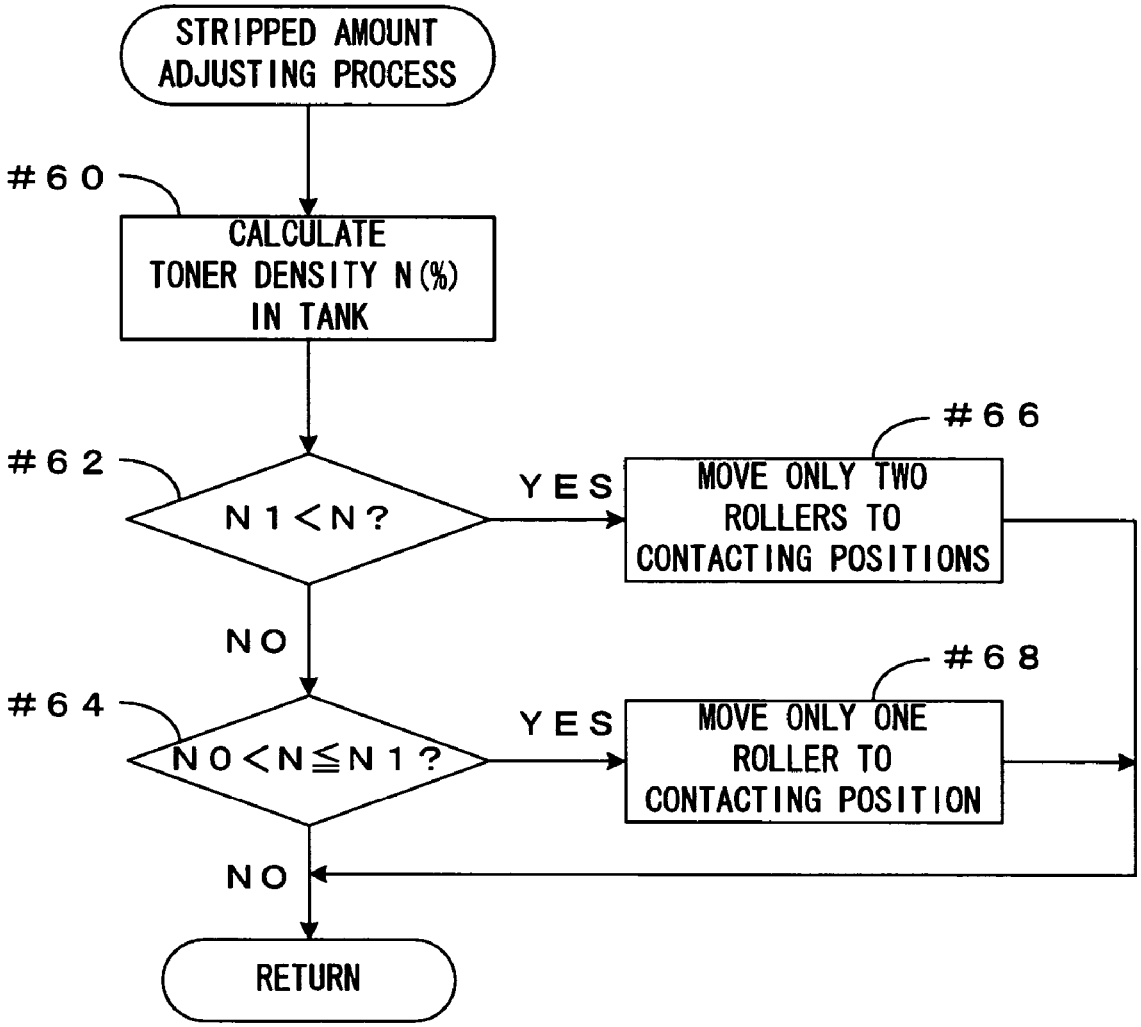
FIG. 14 is a flow chart showing other example of the stripped amount adjusting process routine.

FIG. 14 is a flow chart which shows other example of the stripped amount adjustment process routine. During the illustrated operations, as denoted at the broken line in FIG. 3, the developer unit 30 comprises the viscometer 39. The viscometer 39 is disposed inside the tank 33, and the CPU 113 calculates a toner density based on the viscosity of the liquid developer 32 which is detected by the viscometer 39. Instead of the viscometer 39, a density sensor formed by a transmission-type optical sensor for example may be disposed inside the tank 33 and the sensor itself may detect the toner density in the liquid developer 32 which is within the tank 33. In this embodiment, the viscometer 39 corresponds to the "density detecting device" of the present invention.

First, the toner density N (%) in the liquid developer 32 which is within the tank 33 is calculated based on a detection signal obtained by the viscometer 39 (#60). A relationship between the viscosity of the liquid developer 32 which is detected by the viscometer 39 and the toner density in the liquid developer 32 is identified in the form of an arithmetic expression or table data in advance and contained in the program which is stored in the memory 116. The processing of calculating a toner density at #60 is executed based on the relationship described above.

Whether thus calculated toner density is N1<N is determined (#62). When N≦N1 holds truth (NO at #62), whether N0<N≦N1 is determined (#64). When N≦N0 holds truth (NO at #62), since this means that the toner density has dropped, this routine is terminated without stripping off the carrier liquid. N0 is an initial value of the toner density in the liquid developer 32 which is within the tank 33, and N1 is a value which is calculated through experiments or the like in advance and satisfies the relationship N0<N1.

On the other hand, when N1<N holds truth (YES at #62), since this means that the toner density has largely increased, the squeegee rollers 51 and 52 for example are moved to the contacting positions (#66) as described with reference to FIGS. 7A through 7D. Since two rollers may be moved at this stage, the squeegee rollers 51 and 53 or the squeegee rollers 52 and 53 may be moved to the contacting positions.

Further, when N0<N≦N1 holds truth (YES at #64), the toner density has just slightly increased. Therefore, the squeegee roller 51 for instance is moved to the contacting position (#68) as described with reference to FIGS. 6A through 6D. Since only one roller may be moved at this stage, the squeegee roller 52 or 53 may be moved to the contacting position instead of the squeegee roller 51.

Alternatively, values of the viscosity of the liquid developer 32 which correspond to comparison values of the toner density in the liquid developer 32 (N0 and N1 in FIG. 14) may be identified and stored in the memory 116 in advance based on the relationship between the viscosity of the liquid developer 32 which is detected by the viscometer 39 and the toner density in the liquid developer 32, and the detected viscosity may be compared with a corresponding value directly, to thereby make the judgments at the steps #62 and #64 in FIG. 14.

As described above, the second preferred embodiment uses the squeegee rollers 51 through 53 which can move between the contacting position to contact with the liquid developer 32 which is on the intermediate transfer roller 41 and the clear-off position to be away from the liquid developer 32 which is on the intermediate transfer roller 41 and a combination of the squeegee rollers 51 through 53 which are moved to the contacting positions is controlled. Hence, it is possible to control a stripped amount of the carrier liquid 321 which is stripped off from the intermediate transfer roller 41. This permits to adjust an amount of the carrier liquid contained in the liquid developer on the intermediate transfer roller 41. That is, the control may be provided to decrease the amount of the carrier liquid 321 whereby the toner density (or the ratio between the toner and the carrier liquid) in the liquid developer adherent to the intermediate transfer roller 41 may be adjusted.

Further, the second preferred embodiment includes the carrier dispenser 57, which provides for the control to increase the amount of the carrier liquid 321 by adjusting the amount of carrier liquid 321 supplied onto the intermediate transfer roller 41. Thus, the embodiment is adapted for the controls to increase and to decrease the amount of carrier liquid 321 and hence, the amount of carrier liquid on the intermediate transfer roller 41 may be controlled as desired. Accordingly, the embodiment can adjust the toner density in the liquid developer 32 adherent to the intermediate transfer roller 41. Even if the toner density in the liquid developer 32 on the intermediate transfer roller 41 is increased or decreased from the predetermined value, it is ensured that the toner density is constantly maintained at values near the predetermined value. This results in the reduced changes of the transfer conditions under which the image is transferred from the intermediate transfer roller 41 to the recording medium such as the transfer sheet 4. The image transfer may be performed substantially under the consistent transfer conditions so that the good image quality may be achieved. Furthermore, the positive control of the transfer conditions is ensured because the toner density is adjusted just before the toner image is transferred to the recording medium such as the transfer sheet 4.

Third Preferred Embodiment

Figure 15:
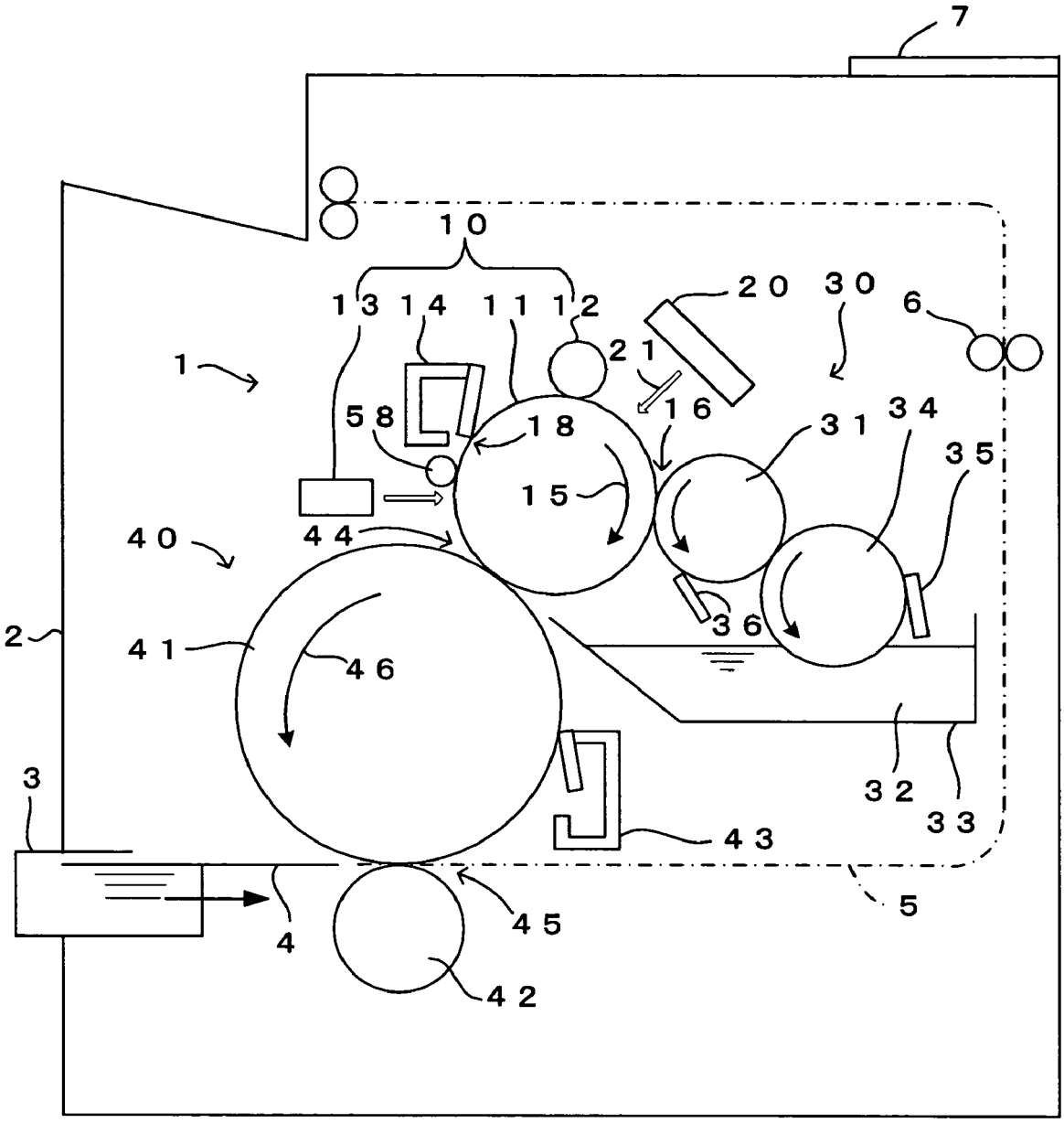
FIG. 15 is a drawing which shows an internal structure of a printer which is a third preferred embodiment of the present invention.
Figure 16:
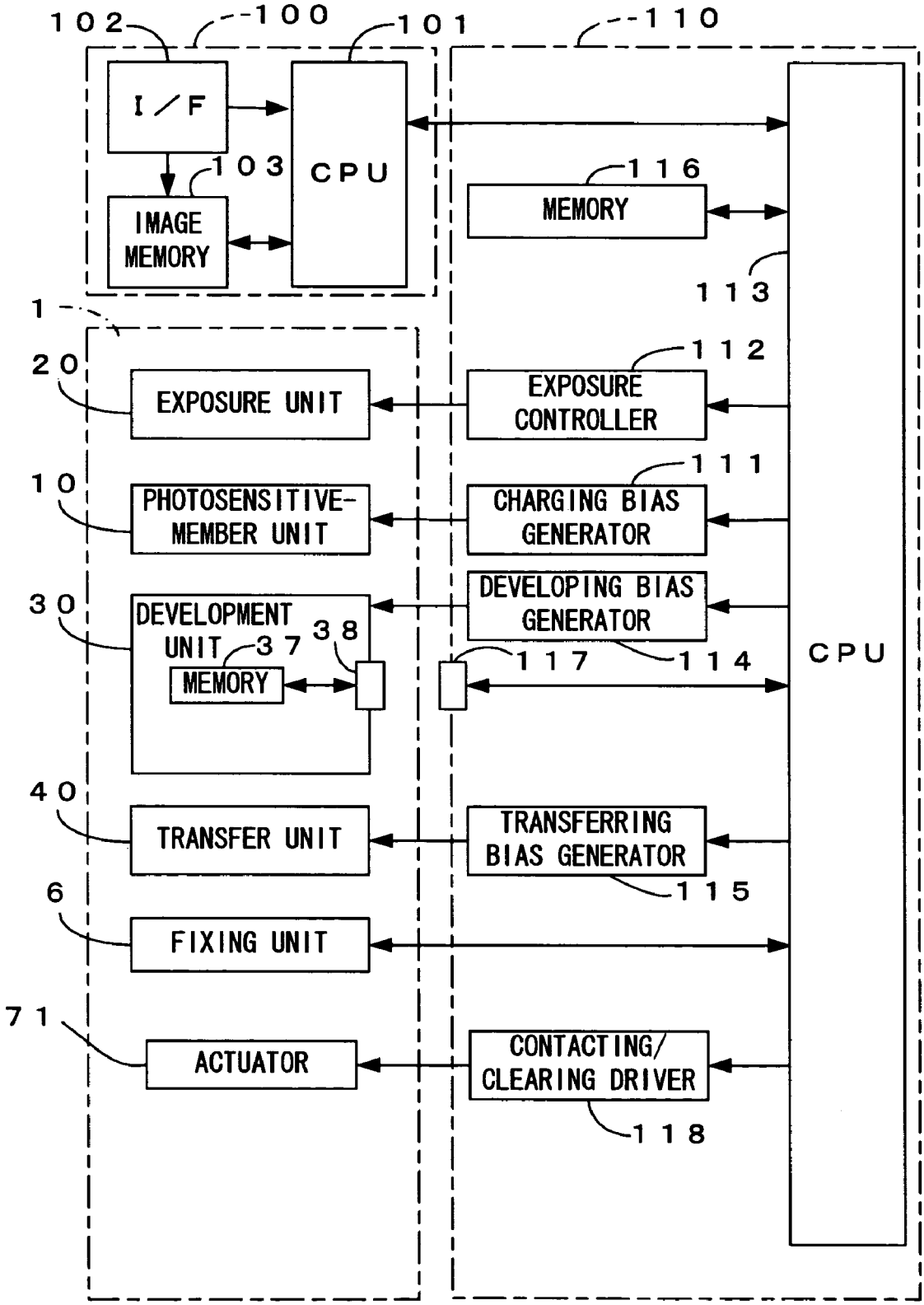
FIG. 16 is a block diagram showing an electric structure of the printer of FIG. 15.

FIG. 15 is a drawing which shows an internal structure of a printer as an image forming apparatus according to a third preferred embodiment of the present invention, and FIG. 16 is a block diagram showing an electric structure of the printer. The third preferred embodiment principally differs from the first and second preferred embodiments in that the squeegee rollers 51 through 53 and the carrier dispenser 57 are not provided and that a dispersing-state adjusting roller 58 is disposed between the primary transferring position 44 and a cleaning position 18 and facing with the photosensitive member 11. The other parts are basically arranged the same way as in the first and second preferred embodiments and hence, the same elements are denoted at the same reference symbols and will not be described. The following description is made on the features of the third preferred embodiment, focusing on the differences from the foregoing embodiments.

According to the third preferred embodiment, the toner image formed on the photosensitive member 11 (corresponding to a "first image carrier" of the present invention) is transported to a primary transferring position 44 (corresponding to a "transferring position" of the present invention) which faces the intermediate transfer roller 41, as the photosensitive member 11 rotates. The intermediate transfer roller 41 rotates approximately at the same circumferential speed as the photosensitive member 11 in a direction which follows the photosensitive member 11 (the anti-clockwise direction in FIG. 15). When the transferring bias generator 115 applies a primary transferring bias (which may be DC−400 V for instance), the toner image on the photosensitive member 11 is primarily transferred onto the intermediate transfer roller 41 (a primary transferring step). The static eliminator 13 formed by an LED or the like removes an electric charge remaining on the photosensitive member 11 after the primary transfer, and the cleaner 14 removes the liquid developer which remains at the cleaning position 18 (a cleaning step). The cleaner 14 is constituted by scraping device such as a cleaning blade. Thus in the third preferred embodiment, the cleaner 14 corresponds to "cleaning device" of the present invention, the intermediate transfer roller 41 corresponds to a "second image carrier" of the present invention, and the transferring bias generator 115 corresponds to "transferring bias generator" of the present invention.

The dispersing-state adjusting roller 58 is disposed facing against an area on the photosensitive member 11 between the primary transferring position 44 and the cleaning position 18. The dispersing-state adjusting roller 58 is supported in such a manner that the dispersing-state adjusting roller 58 can move in a direction closer to and away from the photosensitive member 11. In short, when a contacting/clearing driver 118 (FIG. 16) drives an actuator 71 (FIG. 16) which is formed by a solenoid, a motor or the like for instance, the dispersing-state adjusting roller 58 reciprocally move between contacting position and clear-off position. The contacting position is such a position at which the dispersing-state adjusting roller 58 contacts with the liquid developer which is carried on the photosensitive member 11. The clear-off position is such a position at which the dispersing-state adjusting roller 58 remains not in contact with the above-mentioned liquid developer. When positioned at the contacting position, the dispersing-state adjusting roller 58 rotates in a direction to follow the photosensitive member 11. The dispersing-state adjusting roller 58 adjusts a dispersing state of toner in the liquid developer 32 on the photosensitive member 11. The operation of the dispersing-state adjusting roller 58 will be described hereinlater.

The secondary transfer roller 42 is disposed to face with an appropriate portion of the intermediate transfer roller 41 (right below the intermediate transfer roller 41 in FIG. 15). The primarily transferred toner image which has been primarily transferred onto the intermediate transfer roller 41 is transported to a secondary transferring position 45 facing the secondary transfer roller 42, as the intermediate transfer roller 41 rotates. Meanwhile, the transfer sheet 4 housed in the paper cassette 3 is transported to the secondary transferring position 45 by a transportation driver (not shown), in synchronization to the transportation of the primarily transferred toner image. The secondary transfer roller 42 rotates approximately at the same circumferential speed as the intermediate transfer roller 41 in a direction which follows the intermediate transfer roller 41 (the clockwise direction in FIG. 15). As the transferring bias generator 115 applies a secondary transferring bias (which may be −100 μA for example under constant current control) upon the secondary transfer roller 42, the toner image on the intermediate transfer roller 41 is secondarily transferred onto the transfer sheet 4 (a secondary transferring step). A cleaner 43 removes the liquid developer which remains on the intermediate transfer roller 41 after the secondary transfer. The transfer sheet 4 to which the toner image has been secondarily transferred in this manner is transported along a predetermined transfer paper transportation path 5 (denoted at the dashed line in FIG. 15), subjected to fixing of the toner image by a fixing unit 6, and discharged into a discharge tray which is disposed in an upper portion of the apparatus body 2. An operation display panel 7 comprising a liquid crystal display and a touch panel is disposed in a top surface of the apparatus body 2. The operation display panel 7 accepts an operation instruction from a user, and shows predetermined information to inform the user of the information.

Figure 17A:
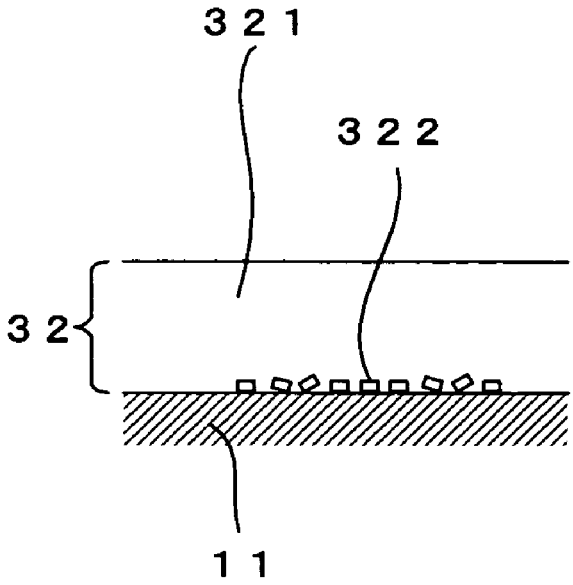
FIGS. 17A and 17B are explanatory drawings which shows an adjusting operation of a dispersing state of toner.
Figure 17B:
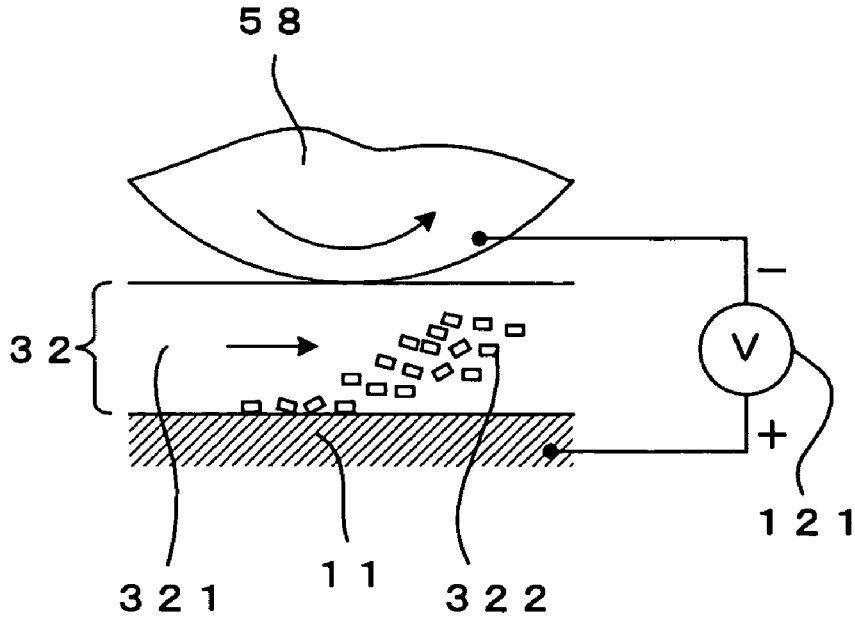

Next, the operation of the dispersing-state adjusting roller 58 is specifically described with reference to FIGS. 17A and 17B. FIGS. 17A and 17B are explanatory drawings which shows an adjusting operation of a dispersing state of toner in the liquid developer 32 on the photosensitive member 11. FIG. 17A shows a state of the toner on the photosensitive member 11 after the primary transfer and prior to the adjusting operation by the dispersing-state adjusting roller 58. FIG. 17B shows the operation of the dispersing-state adjusting roller 58 adjusting the dispersing state of the toner. For the convenience of illustration, the photosensitive member 11 is depicted as a flat plate.

In FIG. 17A, a toner 322 (post-transfer residual toner) which was not transferred from the photosensitive member 11 onto the intermediate transfer roller 41 (the primary transfer) remains on the photosensitive member 11 along with the carrier liquid 321. As shown in the figure, such a post-transfer residual toner 322 agglutinates on the photosensitive member 11 or sticks thereto. In this state, the cleaner 14 cannot remove the whole amount of residual toner 322 by scraping or such and hence, some of the residual toner 322 still remains after the cleaning operation.

As shown in FIG. 17B, therefore, the dispersing-state adjusting roller 58 is brought into contact with the liquid developer 32 on the photosensitive member 11 so as to apply a bias by means of an adjusting bias generator 121 connected between the photosensitive member 11 and the dispersing-state adjusting roller 58. The bias applied by the adjusting bias generator 121 is the same polarity as the primary transferring bias applied from the transferring bias generator 115. That is, in a case where the toner used is charged positive, the bias voltage applied by the adjusting bias generator 121 is directed to move the toner 322 from the lower side (the photosensitive member 11) to the upper side (the dispersing-state adjusting roller 58). The dispersing-state adjusting roller 58 rotates in a direction to follow the movement of the liquid developer 32 on the photosensitive member 11 (the rightward direction as seen in the figure) by being brought into contact with the liquid developer 32 on the photosensitive member 11. Thus, the toner 322 agglutinated on the photosensitive member 11 is moved toward the dispersing-state adjusting roller 58 (the surface layer of the liquid developer 32) by an electric field produced between the photosensitive member 11 and the dispersing-state adjusting roller 58. As a result, the cleaning operation, such as based on scraping, of the cleaner 14 is facilitated. It is noted here that the bias voltage applied by the adjusting bias generator 121 is not limited to a DC bias and may also include an AC bias. In the case of the AC bias, however, the bias need be changed in the duty ratio of the alternating cycle or the like such as to attractively converge the toner to either one of the rollers (to the dispersing-state adjusting roller 58 in this case). Thus, in the embodiment, the dispersing-state adjusting roller 58 corresponds to a "contacting member" of the present invention, and the adjusting bias generator 121 corresponds to "voltage applying device" of the present invention.

The voltage applied by the adjusting bias generator 121 may preferably be a bias voltage producing a greater electric field between the photosensitive member 11 and the dispersing-state adjusting roller 58, as compared with an electric field produced by the primary transferring bias applied by the transferring bias generator 115. By applying such a level of bias voltage, a greater attractive force than that in the primary transfer is applied to the toner 322, the attractive force acting to move the toner toward the dispersing-state adjusting roller 58 in this case. Accordingly, even the post-transfer residual toner 322 which was not transferred from the photosensitive member 11 to the intermediate transfer roller 41 during the primary transfer, is positively moved toward the surface layer of the liquid developer 32. Thus, the post-transfer residual toner 322 on the photosensitive member 11 is totally moved toward the surface layer of the liquid developer 32 prior to the execution of the cleaning operation, so that the cleaning operation is facilitated.

In an alternative arrangement wherein the adjusting bias generator 121 is provided with an additional AC bias source (not shown), an additional AC bias can be superimposed on the existing DC (or AC) bias. Accordingly, the dispersing state of the toner in the liquid developer 32 may be disturbed by subjecting the toner 322 to the attractive force by the existing bias (the force to move the toner toward the dispersing-state adjusting roller 58) in combination with alternating attractive force and repulsive force based on the frequency of the AC bias. Even if the toner 322 is stuck to the photosensitive member 11, therefore, the toner 322 is urged into movement so as to be separated from the photosensitive member 11 and to be moved in the carrier liquid 321. As a result, the post-transfer residual toner 322 may be completely cleaned off.

As described above, the third preferred embodiment facilitates the cleaning operation, such as based on scraping, of the cleaner 14 because the adjusting bias generator 121 is so controlled as to move the toner 322 toward the surface layer of the liquid developer 32 while the dispersing-state adjusting roller 58 is held in contact with the liquid developer 32 on the photosensitive member 11. Thus, the post-transfer residual toner 322 is completely cleaned off and hence, the good image quality may be achieved.

Fourth Preferred Embodiment

The third preferred embodiment described above has the arrangement wherein the dispersing state of the toner in the liquid developer is adjusted, the liquid developer remaining on the photosensitive member 11 after the toner image on the photosensitive member 11 is transferred to the intermediate transfer roller 41 (the primary transfer). Alternatively, the dispersing state of the toner in the liquid developer remaining on the intermediate transfer roller 41 may be adjusted after the toner image on the intermediate transfer roller 41 is transferred to the recording medium such as the transfer sheet 4 (the secondary transfer). In this case, the post-transfer residual toner remaining on the intermediate transfer roller 41 after the secondary transfer may be readily cleaned off.

Figure 18:
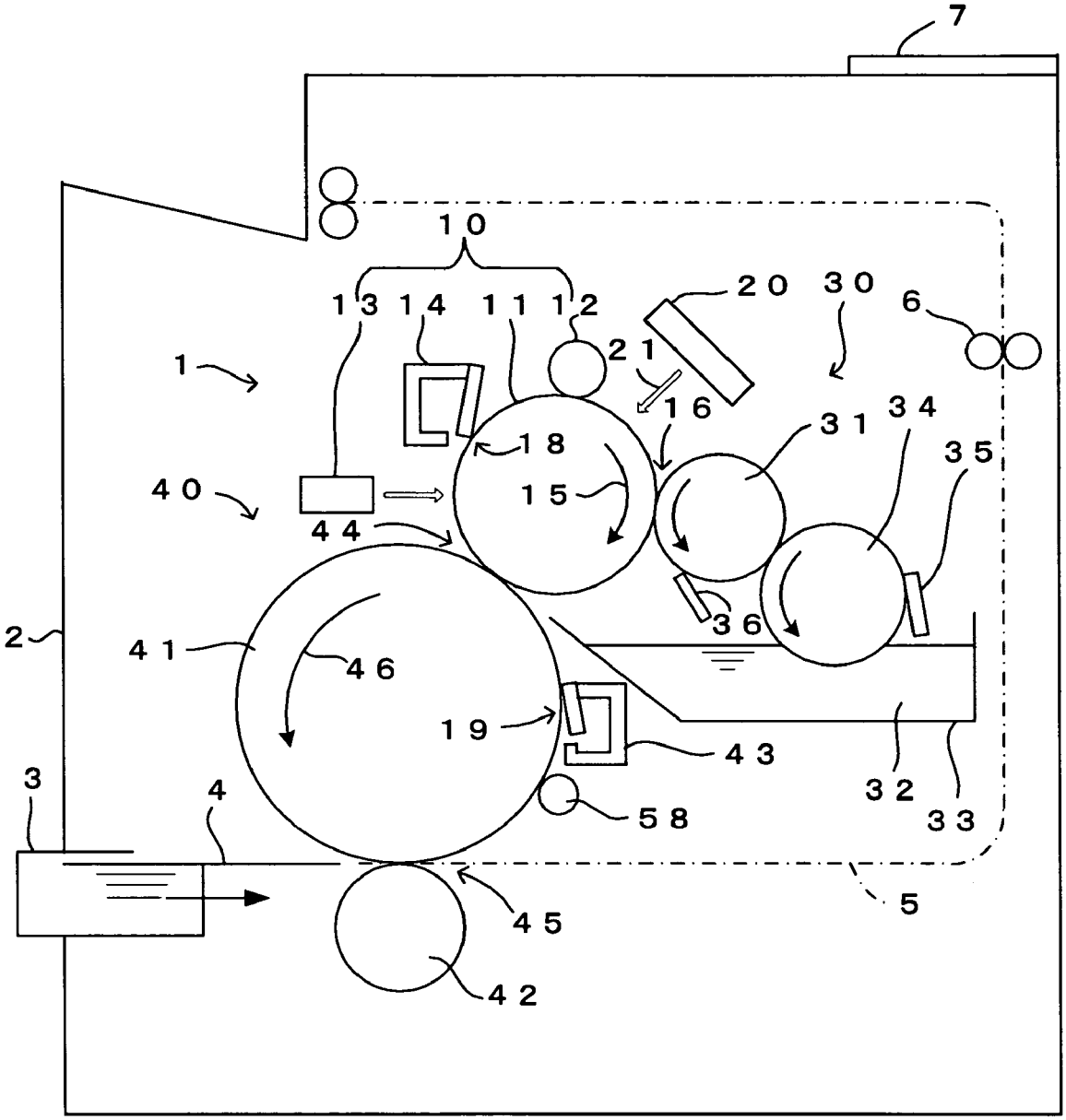
FIG. 18 is a drawing which shows an internal structure of a printer which is a fourth preferred embodiment of the present invention.

FIG. 18 is a drawing which shows an internal structure of a printer which is a fourth preferred embodiment of the present invention. The fourth preferred embodiment principally differs from the third preferred embodiment in that the dispersing-state adjusting roller 58 is disposed between the secondary transferring position 45 (corresponding to a "transferring position" of the present invention) and a cleaning position 19 of the cleaner 43 on the intermediate transfer roller 41 facing with the intermediate transfer roller 41 rather than with the photosensitive member 11. The other parts are basically arranged the same way as in the third preferred embodiment and hence, like parts are denoted at the same reference symbols, respectively, and will not be described. The following description is made on the features of this embodiment, focusing on the difference from the above embodiment.

According to the fourth preferred embodiment, the dispersing-state adjusting roller 58 adjusts the dispersing state of the toner in the liquid developer 32 as held in contact with the liquid developer 32 remaining on the intermediate transfer roller 41 after the secondary transfer. The adjusting operation of the roller is basically the same as that of the third preferred embodiment. Specifically, the dispersing-state adjusting roller 58 is brought into contact with the liquid developer 32 on the intermediate transfer roller 41 so as to apply a bias by means of the adjusting bias generator 121 connected between the intermediate transfer roller 41 and the dispersing-state adjusting roller 58. The bias applied by the adjusting bias generator 121 is the same polarity as the secondary transferring bias applied from the transferring bias generator 115. That is, in a case where the toner used is charged positive, the bias voltage applied by the adjusting bias generator 121 is directed to move the toner 322 from the intermediate transfer roller 41 to the dispersing-state adjusting roller 58. Thus, the toner 322 agglutinated on the surface of the intermediate transfer roller 41 moves toward the dispersing-state adjusting roller 58 (the surface layer of the liquid developer 32) by the electric field produced between the intermediate transfer roller 41 and the dispersing-state adjusting roller 58. As a result, the cleaning operation, such as based on scraping, of the cleaner 43 is facilitated.

Similarly to the third preferred embodiment, the voltage applied by the adjusting bias generator 121 may preferably be a bias voltage producing the greater electric field between the intermediate transfer roller 41 and the dispersing-state adjusting roller 58, as compared with the electric field produced by the secondary transferring bias applied from the transferring bias generator 115. By applying such a level of bias voltage, a greater attractive force than that in the secondary transfer is applied to the toner 322, the attractive force acting to move the toner toward the dispersing-state adjusting roller 58 in this case. Accordingly, even the post-transfer residual toner 322 which was not transferred from the intermediate transfer roller 41 to the transfer sheet 4 during the secondary transfer, is positively brought into movement. Thus, the post-transfer residual toner 322 on the intermediate transfer roller 41 is totally moved toward the surface layer of the liquid developer 32 prior to the execution of the cleaning operation and hence, the cleaning operation is facilitated. According to the fourth preferred embodiment, the cleaner 43 corresponds to the "cleaning device" of the present invention, the intermediate transfer roller 41 corresponds to the "first image carrier" of the present invention, and the transfer sheet 4 corresponds to the "second image carrier" of the present invention.

Likewise to the third preferred embodiment, the fourth preferred embodiment may also adopt the arrangement wherein the adjusting bias generator 121 further includes the additional AC bias source. Even if the toner 322 is stuck to the intermediate transfer roller 41, therefore, the toner 322 is urged into movement so as to be separated from the intermediate transfer roller 41 and to be moved in the carrier liquid 321. As a result, the post-transfer residual toner 322 may be completely cleaned off.

Fifth Preferred Embodiment

Figure 19:
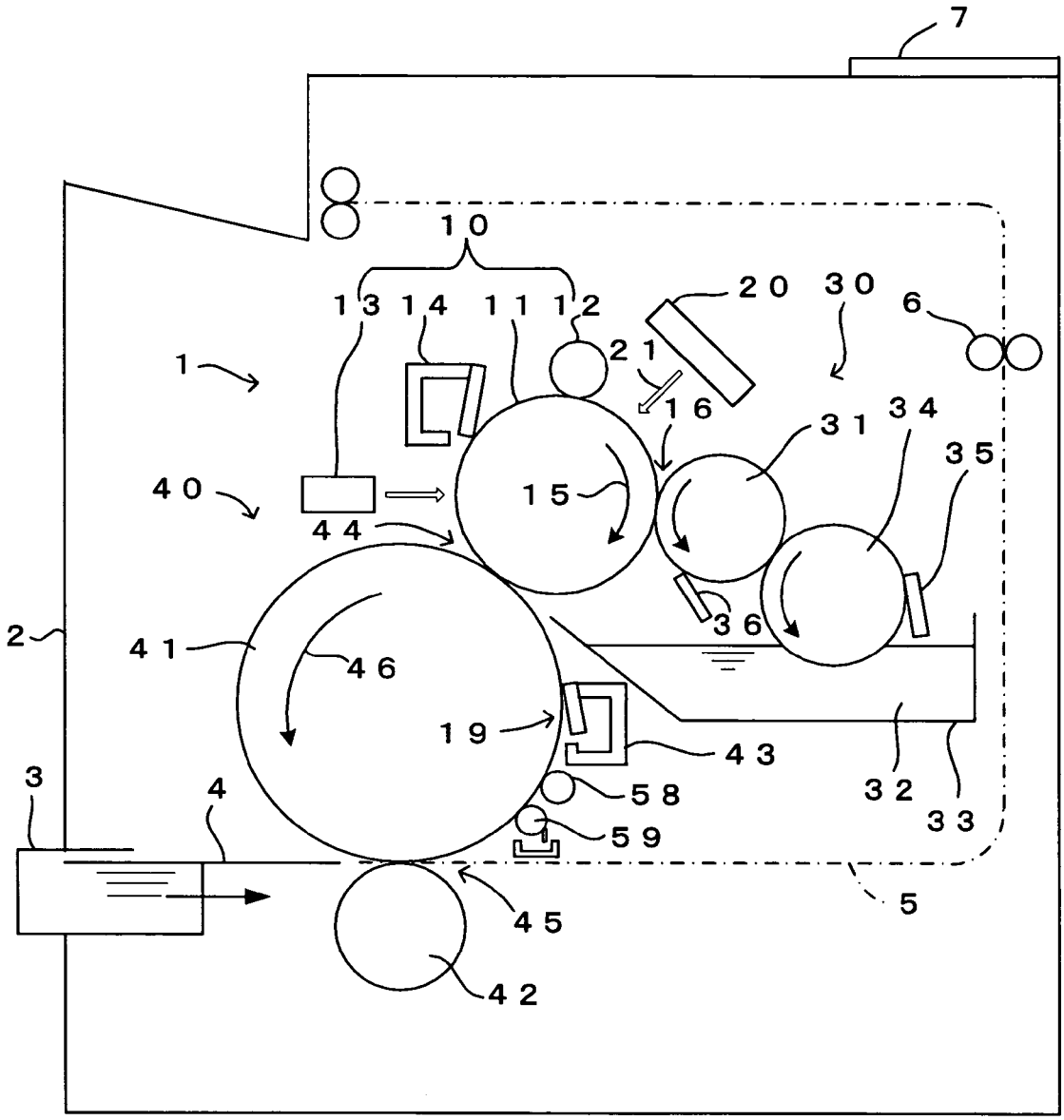
FIG. 19 is a drawing which shows an internal structure of a printer which is a fifth preferred embodiment of the present invention.
Figure 20:
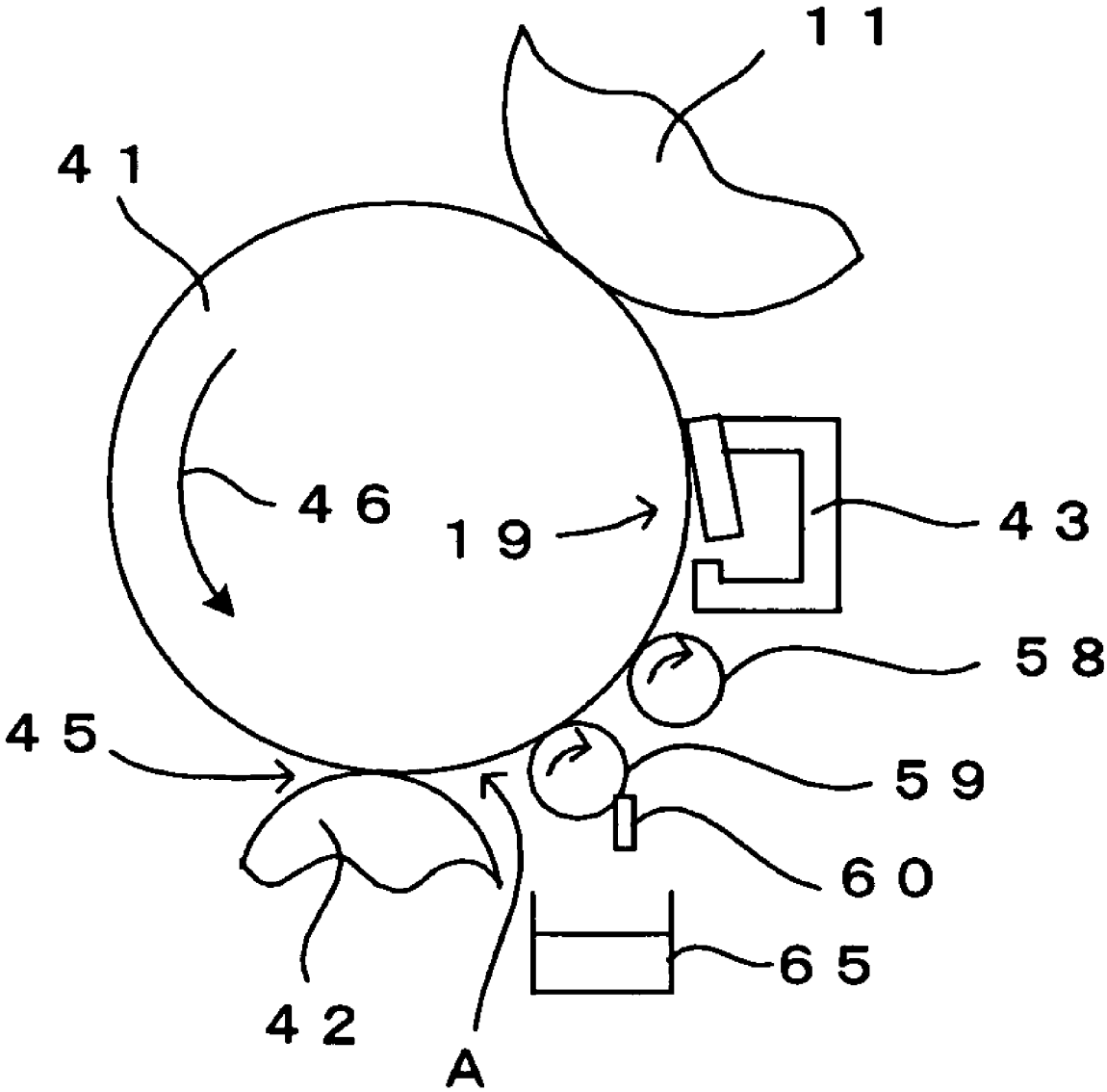
FIG. 20 is an enlarged view of a principal part of FIG. 19.
Figure 21:
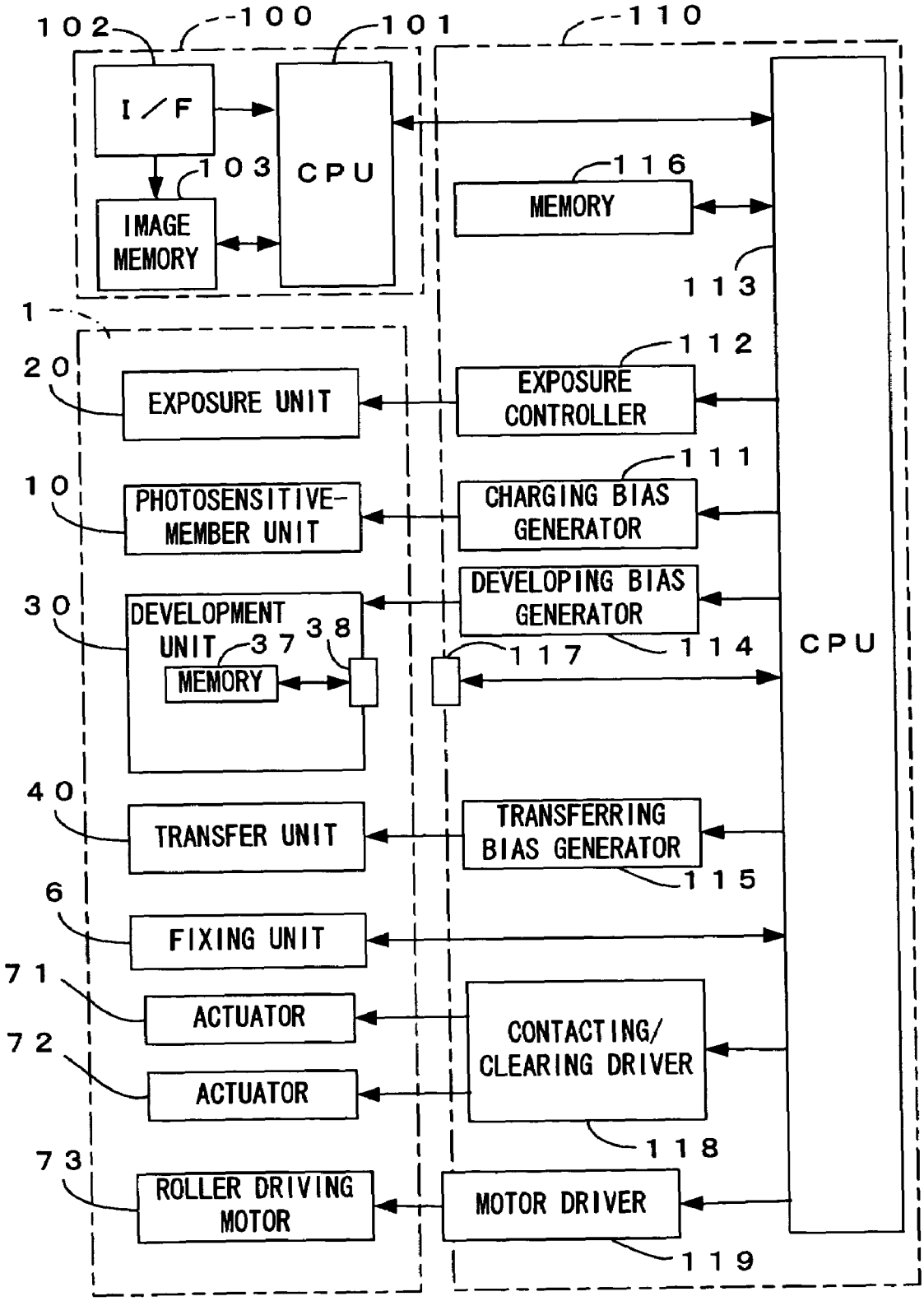
FIG. 21 is a block diagram showing an electric structure of the printer of FIG. 19.

FIG. 19 is a drawing which shows an internal structure of a printer as an image forming apparatus according to a fifth preferred embodiment of the present invention, FIG. 20 is an enlarged view of a principal part of FIG. 19, and FIG. 21 is a block diagram showing an electric structure of the printer. The fifth preferred embodiment differs from the fourth preferred embodiment in that a toner-density adjusting roller 59 is further added, the toner-density adjusting roller 59 disposed between the secondary transferring position 45 and the cleaning position 19 of the cleaner 43 on the intermediate transfer roller 41 facing with the intermediate transfer roller 41. The other parts are basically arranged the same way as in the fourth preferred embodiment and hence, like parts are denoted at the same reference symbols, respectively, and will not be described. The following description is made on the features of the fifth preferred embodiment, focusing on the difference from the above embodiment.

The toner-density adjusting roller 59 is disposed facing against an area on the photosensitive member 11 which is downstream from the secondary transferring position 45 and upstream from the dispersing-state adjusting roller 58 with respect to the rotational direction 46 of the intermediate transfer roller 41. The toner-density adjusting roller 59 is supported in such a manner that the toner-density adjusting roller 59 can move in a direction closer to and away from the intermediate transfer roller 41. In short, when a contacting/clearing driver 118 (FIG. 21) drives an actuator 72 (FIG. 21) which is formed by a solenoid, a motor or the like for instance, the toner-density adjusting roller 59 reciprocally move between contacting position and clear-off position. The contacting position is such a position at which the toner-density adjusting roller 59 contacts with the liquid developer which is carried on the intermediate transfer roller 41. The clear-off position is such a position at which the toner-density adjusting roller 59 remains not in contact with the above-mentioned liquid developer.

Further, when a motor driver 119 (FIG. 21) drives roller driving motors 73 (FIG. 21) into rotations at the contacting positions, the toner-density adjusting roller 59 rotates approximately at the same circumferential speed as the intermediate transfer roller 41 in a direction which follows the intermediate transfer roller 41 (the clockwise direction in FIG. 20). When located at the contacting position in contact with the carrier liquid which is in a surface layer of the liquid developer 32 which is carried on the intermediate transfer roller 41, the toner-density adjusting roller 59 strips the intermediate transfer roller 41 of the carrier liquid. The details of the carrier liquid stripping operation by the toner-density adjusting roller 59 will be described hereinlater.

As shown in FIG. 20, a cleaning blade 60 abut on the toner-density adjusting roller 59. The carrier liquid stripped off from the intermediate transfer roller 41 by the toner-density adjusting roller 59 is scraped off by the cleaning blade 60 and removed from the toner-density adjusting roller 59. A receiving tray 65 for collecting the carrier liquid is disposed at place under abutment positions for the cleaning blade 60 to abut against the toner-density adjusting roller 59. Thus, the carrier liquid removed from the toner-density adjusting roller 59 by means of the cleaning blade 60 is allowed to drop by gravity so as to be collected in the receiving tray 65. The receiving tray 65 may be communicated with the tank 33 via a pipe (not shown) so that the collected carrier liquid may be returned back to the tank 33 via the pipe by allowing the collected carrier liquid to drop by its own weight or by driving the carrier transport driver such as a pump (not shown).

FIGS. 22A through 22D are drawings for describing an operation of the toner-density adjusting roller 59 stripping off the carrier liquid from the intermediate transfer roller 41. More specifically, the drawings each illustrate an amount of carrier liquid taken away by the toner-density adjusting roller 59 positioned at each of three contacting positions at different distances away from the intermediate transfer roller 41. For the convenience of illustration, the intermediate transfer roller 41 is depicted as a flat plate.

Figure 22A:
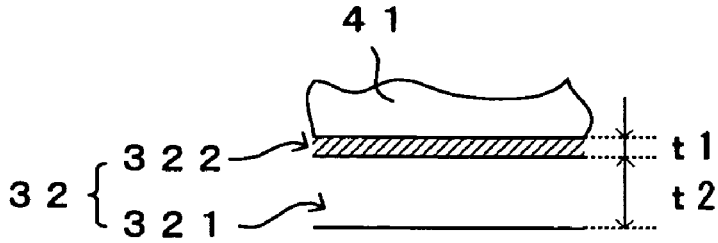
FIGS. 22A through 22D are drawings for describing an operation of stripping off the carrier liquid.

In this embodiment, the actuator 72 (FIG. 21) is formed by a motor or the like and the toner-density adjusting roller 59 can be moved to a plurality of contacting positions which are at different distances from the intermediate transfer roller 41. FIG. 22A shows the post-transfer residual toner 322 and carrier liquid 321 in the region A shown in FIG. 20, which is located on an upstream side from the toner-density adjusting roller 59 with respect to the rotational direction 46 of the intermediate transfer roller 41. The post-transfer residual toner 322 and carrier liquid 321 remain on the intermediate transfer roller 41 after the toner image on the intermediate transfer roller 41 is transferred to the recording medium such as the transfer sheet 4 (the secondary transfer). The post-transfer residual toner 322 has the mean thickness t1 and the carrier liquid 321 has the mean thickness t2 in the figure. The radius of the toner-density adjusting roller 59 is R.

Figure 22B:
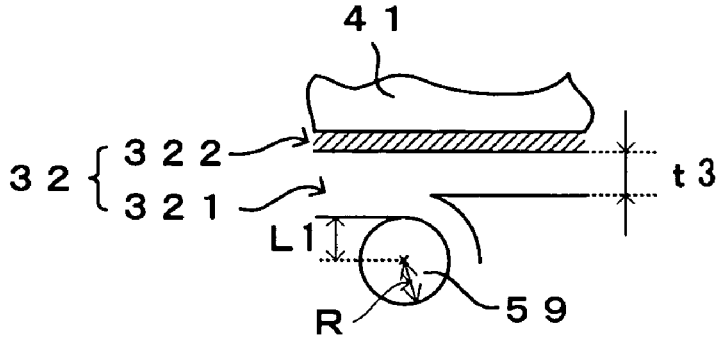

In FIG. 22B, the contacting position is such a position at which the surface of the toner-density adjusting roller 59 barely contacts the liquid developer 32 which is on the intermediate transfer roller 41. That is, a distance L1 between the center of the toner-density adjusting roller 59 and the surface of the liquid developer 32 is set to satisfy $L1 \approx R$ and $L1 \leqq R$. This ensures that the carrier liquid 321 which remains on the intermediate transfer roller 41 has thickness t3 and only a small amount of the carrier liquid 321 which is in the surface layer of the liquid developer 32 on the intermediate transfer roller 41 is stripped away.

Figure 22C:
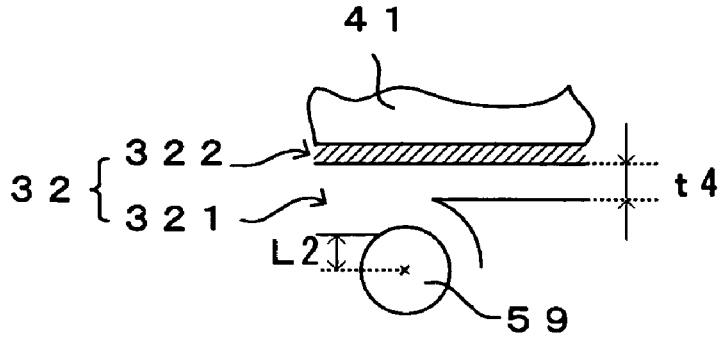

In FIG. 22C, the contacting position is such a position which is closer to the intermediate transfer roller 41 than in FIG. 22B. In other words, a distance L2 between the center of the toner-density adjusting roller 59 and the surface of the liquid developer 32 is set to satisfy L2<L1. This ensures that the carrier liquid 321 which remains on the intermediate transfer roller 41 has thickness t4 (<t3) and more carrier liquid 321 which is in the surface layer of the liquid developer 32 on the intermediate transfer roller 41 is stripped away than in FIG. 22B.

Figure 22D:
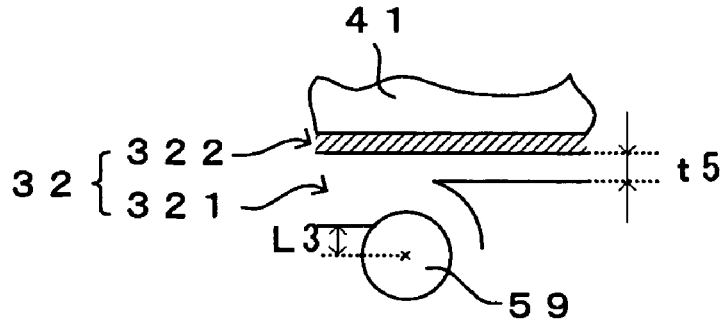

In FIG. 22D, the contacting position is such a position which is even closer to the intermediate transfer roller 41 than in FIG. 22C. In short, a distance L3 between the center of the toner-density adjusting roller 59 and the surface of the liquid developer 32 is set to satisfy L3<L2. This ensures that the carrier liquid 321 which remains on the intermediate transfer roller 41 has thickness t5 (<t4) and even more carrier liquid 321 which is in the surface layer of the liquid developer 32 on the intermediate transfer roller 41 is stripped away than in FIG. 22C.

As described above, as for the contacting positions for the toner-density adjusting roller 59, the toner-density adjusting roller 59 can be moved to a plurality of contacting positions which are at different distances from the intermediate transfer roller 41 according to the embodiment shown in FIGS. 22A through 22D. With the contacting positions for the toner-density adjusting roller 59 changed therefore, a stripped amount of the carrier liquid 321 off from the intermediate transfer roller 41 is controlled, thereby adjusting the amount of the carrier liquid contained in the liquid developer 32 on the intermediate transfer roller 41. In other words, the toner density in the liquid developer adherent to the intermediate transfer roller 41 (the ratio between the toner and the carrier liquid) may be adjusted by controlling the stripped amount of the carrier liquid 321. According to the embodiment, the toner-density adjusting roller 59 corresponds to "toner-density adjusting device" and the "stripping member" of the present invention.

As described above, according to the fifth preferred embodiment, the ratio between the toner 322 and the carrier liquid 321 on the intermediate transfer roller 41 (the toner density) is adjusted prior to the adjusting of the dispersing state of the toner 322 in the liquid developer 32 on the intermediate transfer roller 41, whereby the toner density in the liquid developer on the intermediate transfer roller 41 may be adjusted to a level suited for the dispersing-state adjusting roller 58 to adjust the dispersing state of the toner 322 in the liquid developer. As a result, the cleaning operation by the cleaner 43 is even more facilitated. The post-transfer residual toner 322 may be completely removed so that the good image quality is ensured.

Further, according to the fifth preferred embodiment, the carrier liquid 321 scraped off from the toner-density adjusting roller 59 by means of the cleaning blade 60 is allowed to drop by its own weight so as to be collected in the receiving tray 65, form which the carrier liquid is returned back to the tank 33. Hence, the embodiment negates the need for providing a separate device for collecting the carrier liquid 321 from the toner-density adjusting roller 59 and transporting the collected carrier liquid to the receiving tray 65. This leads to a simplified construction of the apparatus. Furthermore, the carrier liquid 321 stripped off is returned back to the tank 33, so that the wastage of the carrier liquid 321 is obviated to achieve an effective use thereof. Thus, the replenishment of the carrier liquid 321 may be reduced to the minimum required level.

<Modifications>

It is to be noted that the present invention is not limited to the foregoing embodiments and various changes or modifications may be made thereto within the scope of the present invention. For instance, the following modifications may be adopted.

(1) Although the first and the second preferred embodiments described above comprise three squeegee rollers 51 through 53, this is not limiting. Two, four or more squeegee rollers may be used instead. To be more specific, where a plurality of squeegee rollers are disposed, with a combination of the squeegee rollers which are moved to the contacting positions controlled, it is possible to control a stripped amount of the carrier liquid 321 which is stripped off from the intermediate transfer roller 41.

(2) The squeegee rollers 51 through 53 according to the first and second preferred embodiments may be arranged to operate the same way as the toner-density adjusting roller 59 according to the fifth preferred embodiment (see FIGS. 22A through 22D). That is, as the contacting positions for the squeegee rollers 51 through 53, three contacting positions which are at different distances from the intermediate transfer roller 41 may be provided. According to this modification, it is thus possible to control a stripped amount of the carrier liquid 321 off from the intermediate transfer roller 41 by changing the contacting positions for the squeegee rollers 51 through 53, and therefore, to achieve a similar effect to that according to the first and second preferred embodiments described above. In this modification, to dispose a plurality of squeegee rollers is not limiting. Only one squeegee roller may be disposed instead. In this case as well, it is possible to control a stripped amount of the carrier liquid 321.

(3) In the first and the second preferred embodiments described above, the rotation speeds of the squeegee rollers 51 through 53 may be changed using the roller driving motor 64 to thereby change the relative velocities of the contact surfaces of the squeegee rollers 51 through 53 relative to the liquid developer which is transported by the intermediate transfer roller 41. Such a modification allows to increase or decrease a stripped amount of the carrier liquid 321 by increasing or decreasing the circumferential speeds of the squeegee rollers 51 through 53 relative to the circumferential speed of the intermediate transfer roller 41, and hence, to attain a similar effect to those according to the first and the second preferred embodiments described above. In this modification, to dispose a plurality of squeegee rollers is not limiting. Only one squeegee roller may be disposed instead. In this case as well, it is possible to control a stripped amount of the carrier liquid 321.

Further, in the fifth preferred embodiment, the stripped amount of carrier liquid from the intermediate transfer roller 41 is controlled by changing the contacting positions of the toner-density adjusting roller 59. However, the arrangement of the embodiment is not limited to this. An alternative arrangement may be made, for example, that the rotation speeds of the toner-density adjusting roller 59 may be changed using the roller driving motor 73 to thereby change the relative velocities of the contact surfaces of the toner-density adjusting roller 59 relative to the liquid developer which is transported by the intermediate transfer roller 41. Such a modification allows to increase or decrease a stripped amount of the carrier liquid 321 by increasing or decreasing the circumferential speeds of the toner-density adjusting roller 59 relative to the circumferential speed of the intermediate transfer roller 41, and hence, to attain a similar effect to those according to the fifth preferred embodiment described above.

(4) In the first and the second preferred embodiments described above, as shown in FIG. 7A for instance, since the thickness t1 of the toner image 322 is 2 μm and the thickness t2 of the carrier liquid 321 is 8 μm, as the squeegee roller 53 is moved to the contacting position in FIG. 7D, a toner image could be adversely affected. However, in the event that an adverse influence over a toner image is unlikely even when the squeegee roller 53 is moved to the contacting position, e.g., the thickness t1 of the toner image 322 is 1 μm, the squeegee roller 53 may be moved to the contacting position in FIG. 7D for example.

In addition, when an adverse influence over a toner image is unlikely even when the squeegee roller 53 is moved to the contacting position, a step of moving all of the three squeegee rollers 51 through 53 to the contacting positions may be added with one more comparison step, whereas maximum of two squeegee rollers may be moved to the contacting positions during the operations shown in FIGS. 9, 10, 13 and 14.

For instance, during the operations shown in FIGS. 9 and 13, the level of an image occupation ratio to be judged may be divided. That is, three squeegee rollers may be moved to the contacting positions when $0<P\leqq 20$ holds truth, two squeegee rollers may be moved to the contacting positions when $20<P\leqq 35$ holds truth, but one squeegee roller may be moved to the contacting position when $35<P\leqq 55$ holds truth.

Meanwhile, during the operations shown in FIGS. 10 and 14 for instance, a value N2 which satisfies $N1<N2$, too, may be compared with a toner density N, and three squeegee rollers may be moved to the contacting positions when $N2<N$ holds truth, two squeegee rollers may be moved to the contacting positions when $N1<N\leqq N2$ holds truth, but one squeegee roller may be moved to the contacting position when $N0<N\leqq N1$ holds truth.

(5) During the operations shown in FIG. 9 in the first preferred embodiment and FIG. 13 in the second preferred embodiment described above, it is not possible to sufficiently collect the carrier liquid in an area where an image occupation ratio is low, and the toner density within the tank 33 tends to increase. That is, as shown in FIG. 7A for instance, since the thickness t1 of the toner 322 is 2 μm and the thickness t2 of the carrier liquid 321 is 8 μm, when the squeegee roller 53 is moved to the contacting position in FIG. 7D, a toner image could be adversely affected. Hence, as described earlier with reference to FIGS. 7A through 7D, when an image occupation ratio is 20%, the toner density in the liquid developer 32 which remains on the intermediate transfer roller 41 becomes close to about 14 vol % but fails to reach 20 vol % which is the initial value.

Noting this, at the step #12, #42 for instance, only one squeegee roller may be moved to the contacting position also when $55<P$ holds truth. This allows to increase a collection amount of the carrier liquid 321 and increase the amount of the carrier liquid 321 which is returned back to the tank 33, to suppress an increase in toner density within the tank 33 and maintain the toner density at the initial value as much as possible.

(6) Although the first preferred embodiment described above requires that a collection amount of the carrier liquid 321 is adjusted and the collected carrier liquid 321 is all returned back to the tank 33, this is not limiting. Instead, the carrier liquid 321 may be stripped off as much as possible to the extent that the stripped amount of the carrier liquid 321 remains constant, e.g., to the extent not adversely influencing a toner image, and the amount of the carrier liquid 321 which is returned to the tank 33 may be adjusted in accordance with an image occupation ratio (FIG. 9), a toner density (FIG. 10), etc.

(7) Although the first and the second preferred embodiments described above comprise a dot counter which counts an on-dot count which represents the number of pixels to which toner adheres among pixels which form an electrostatic latent image, and use a ratio of an on-dot count to a dot count of the entire image as an image occupation ratio, a method of calculating an image occupation ratio is not limited to this. An image occupation ratio is a value which corresponds to a development amount, that is, a migration amount of toner which moves to the photosensitive member 11 from the developing roller 31. For instance therefore, a current which flows to the photosensitive member 11 from the developing roller 31 may be detected as a developer current, a migration amount of toner (development amount) may be calculated based on the developer current, and thus calculated amount may be used as an image occupation ratio.

(8) Although the first and the second preferred embodiments described above use the squeegee rollers 51 through 53 which have a roller shape as the stripping member, this is not limiting. A stripping member shaped like a belt may be used instead, for example.

(9) According to the first preferred embodiment, the squeegee rollers 51 through 53 are disposed between the primary transferring position 44 and the secondary transferring position 45 of the intermediate transfer roller 41 and facing with the intermediate transfer roller 41, so that the carrier liquid is stripped off from the intermediate transfer roller 41 prior to the secondary transfer. However, the stripping operation is not limited to this. For instance, the squeegee rollers 51 through 53 may be disposed between the secondary transferring position 45 of the intermediate transfer roller 41 and the cleaner 43, so as to strip off the carrier liquid from the intermediate transfer roller 41 subsequent to the secondary transfer.

(10) Although the squeegee rollers 51 through 53 are all capable of moving between the contacting positions and the clear-off positions in the first and the second preferred embodiments described above, this is not limiting. Instead, at least only one squeegee roller may be capable of thus moving. For instance, according to such a modification which requires that the squeegee roller 51 can thus move and the squeegee rollers 52 and 53 are fixed at the contacting positions, through control of the position of the squeegee roller 51, it is possible to control a combination of the squeegee rollers which are moved to the contacting positions and hence control a stripped amount of the carrier liquid.

(11) The fifth preferred embodiment has the arrangement which is based on the arrangement of the fourth preferred embodiment and which is further provided with the toner-density adjusting roller 59 between the secondary transferring position 45 and the cleaning position 19 of the cleaner 43 on the intermediate transfer roller 41. It is also possible to make an alternative arrangement which may replace the above arrangement or which may be combined with the above arrangement. The alternative arrangement is based on the arrangement of the third preferred embodiment and is further provided with the toner-density adjusting roller 59 between the primary transferring position 44 and the cleaning position 18 of the cleaner 14 on the photosensitive member 11. In this case as well, the same effect as that of the fifth preferred embodiment may be attained. Specifically, the toner density in the liquid developer on the photosensitive member 11 is adjusted to a level suited for the dispersing-state adjusting roller 58 to adjust the dispersing state of the toner 322 in the liquid developer, whereby the cleaning operation by the cleaner 14 may be even more facilitated.

(12) The above third preferred embodiment applies the bias voltage between the dispersing-state adjusting roller 58 and the photosensitive member 11 thereby adjusting the dispersing state of the toner in the liquid developer 32 on the photosensitive member 11. However, the method of adjusting the dispersing state of the toner is not limited to this. Alternatively, the following adjusting embodiment may be adopted.

Figure 23:
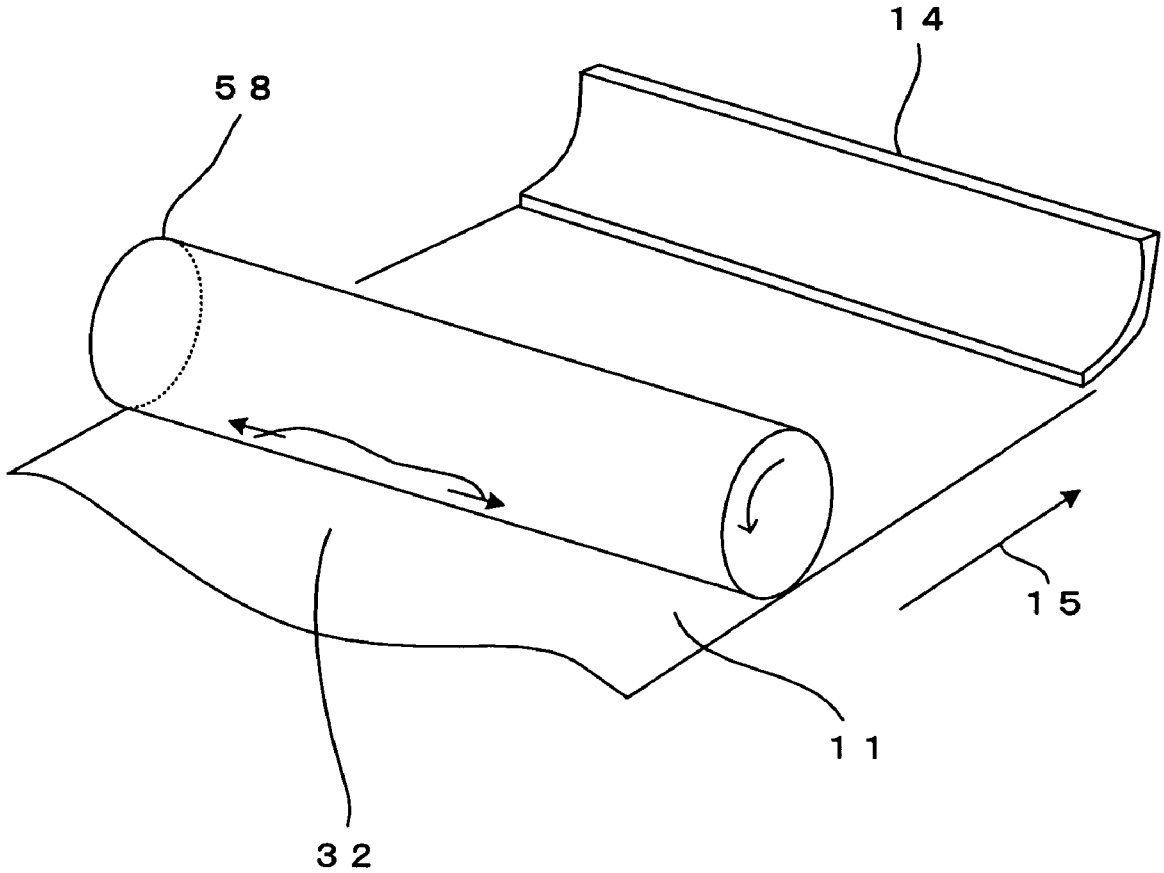
FIG. 23 is an explanatory drawing which shows another operation of adjusting the dispersing state of toner.

FIG. 23 is an explanatory drawing which shows another operation of the dispersing-state adjusting roller 58 for adjusting the dispersing state of the toner in the liquid developer 32 on the photosensitive member 11. For the convenience of illustration, the photosensitive member 11 is depicted as a flat plate. In this adjusting operation, the dispersing-state adjusting roller 58 is positioned at a smaller distance away from the photosensitive member 11 than the thickness of the liquid developer 32 on the photosensitive member 11. As shown in FIG. 23, the liquid developer 32 remaining on the photosensitive member 11 after the primary transfer (liquid developer forwardly of the dispersing-state adjusting roller 58) is nipped between the photosensitive member 11 and the dispersing-state adjusting roller 58 in conjunction with the rotation of the photosensitive member 11 (the rotational direction 15). This results in the following effects. Even though the post-transfer residual liquid developer forms a layer varied in thickness with respect to a widthwise direction because of different image patterns, pressure variations at a transfer section between the photosensitive member 11 and the intermediate transfer roller 41 or such, a thicker portion of the liquid developer layer (a portion containing a greater amount of post-transfer residual liquid developer) is caused to flow toward a peripheral area so that the liquid developer layer is leveled off in the widthwise direction. In addition, the dispersing state of the toner in the liquid developer 32 on individual parts of the photosensitive member 11 are changed. Even though the toner is agglutinated on the photosensitive member 11 after the primary transfer, therefore, the toner is moved toward the surface layer of the liquid developer 32 so that the post-transfer residual toner may be readily scraped off from the photosensitive member 11 by means of the cleaning blade or the like of the cleaner 14. In this adjusting embodiment, the "contacting member" is not limited to the roller-shaped dispersing-state adjusting roller 58 and a blade-like member may also be used.

(13) In still another adjusting embodiment, roller driving device such as a roller driving motor may be provided for varying the circumferential speed of the dispersing-state adjusting roller 58. Thus, the circumferential speed of the dispersing-state adjusting roller 58 may be controlled in a manner that a surface speed of the dispersing-state adjusting roller 58 differs from that of the liquid developer carried by the photosensitive member 11. This adjusting operation permits the circumferential speed of the dispersing-state adjusting roller 58 to be increased or decreased relative to the circumferential speed of the photosensitive member 11, thereby stirring the toner contained in the liquid developer on the photosensitive member 11. Thus is disturbed the dispersing state of the toner in the liquid developer on the photosensitive member 11. Accordingly, even if the toner is agglutinated on the photosensitive member 11 after the primary transfer, the toner may be moved toward the surface layer of the liquid developer 32. Hence, the cleaning operation is facilitated.

(14) The embodiment of adjusting the dispersing state of the toner is not limited to any one of the adjusting embodiments described above in the third preferred embodiment and the modifications (12) and (13). The dispersing state of the toner may be adjusted by a suitable combination of these embodiments. For instance, all the adjusting embodiments may be used in combination. Specifically, in the adjusting embodiment in the modification (12), the bias voltage may be applied between the dispersing-state adjusting roller 58 and the photosensitive member 11 (the adjusting embodiment described in the first preferred embodiment) while the dispersing-state adjusting roller 58 may be so controlled as to rotate at a different circumferential speed from the surface speed of the liquid developer carried on the photosensitive member 11 (the modification (13)). In this case, the respective effects of the individual adjusting embodiments may be attained in combination.

(15) In the fourth and fifth preferred embodiments, as well, the dispersing state of the toner in the liquid developer 32 on the intermediate transfer roller 41 is adjusted by applying the bias voltage between the dispersing-state adjusting roller 58 and the intermediate transfer roller 41. However, the adjusting embodiment is not limited to this. Similarly to the first preferred embodiment, the aforementioned adjusting embodiment described in the modifications (12) through (14) may also be applied.

(16) While the fifth preferred embodiment includes the dispersing-state adjusting roller 58 and the toner-density adjusting roller 59 which are independent from each other, the functions of these rollers may be implemented in a single roller. For instance, the dispersing-state adjusting roller 58 may be dispensed with, while the toner-density adjusting roller 59 may be applied with the bias voltage or so controlled as to rotate at a different circumferential speed from that of the intermediate transfer roller 41. Such an arrangement leads to the simplification and the size reduction of the apparatus.

(17) The fifth preferred embodiment controls the stripped amount of the carrier liquid by means of a single toner-density adjusting roller 59. Alternatively, there may be provided a plurality of toner-density adjusting rollers 59, out of which a combination of the toner-density adjusting rollers to be positioned at the contacting positions to be in contact with the liquid developer on the intermediate transfer roller 41 may be controlled. In this manner, the stripped amount of the carrier liquid may be controlled.

(18) Although the fifth preferred embodiment described above uses the toner-density adjusting roller 59 which have a roller shape as the stripping member, this is not limiting. A stripping member shaped like a belt may be used instead, for example.

(19) Although the third through fifth preferred embodiments described above demand that the intermediate transfer roller 41 is disposed and the secondary transfer roller 42 realizes secondary transfer onto the transfer sheet 4 at the secondary transferring position 45 after a toner image on the photosensitive member 11 has been primarily transferred onto the intermediate transfer roller 41 at the primary transferring position 44, this is not limiting. For instance, the intermediate transfer roller 41 may be omitted and the secondary transfer roller 42 may be disposed at the primary transferring position 44, so as to transfer a toner image on the photosensitive member 11 directly onto the transfer sheet 4 (recording medium). In such a modification, the photosensitive member 11 corresponds to the "first image carrier" of the present invention, and the transfer sheet 4 corresponds to the "second image carrier" of the present invention.

(20) While the first and second preferred embodiments have the arrangement wherein the removed carrier liquid is forcibly returned back to the tank 33 by driving the pump, the arrangement is not limited to this. An alternative arrangement may be made wherein the receiving tray 55 is located at place higher than the tank 33 so that the collected carrier liquid may be allowed to flow down by its own weight into the tank 33. Furthermore, an opening of the tank 33 may be extended to place under the respective abutment positions for the cleaning blades 54 to abut against the individual squeegee rollers 51, 52 and 53, such that the removed carrier liquid may be directly collected in the tank 33 as allowed to drop by its own weight. The arrangement omits the receiving tray 55 and the pipe 56.

(21) The first and second preferred embodiments have the arrangement wherein the whole amount of carrier liquid collected in the receiving tray 55 is returned to the tank 33, the arrangement is not limited to this. For instance, an on-off valve may be provided in the pipe 56 such that only a part of the collected carrier liquid may be returned back to the tank 33 by switching on and off the valve.

(22) While the second preferred embodiment is arranged to return the collected carrier liquid to the tank 33, the collected carrier liquid may be supplied to the carrier dispenser 57 so as to be used as a source of the carrier dispenser 57. In this case, the receiving tray 55 may be used as is as the source of the carrier dispenser 57. Thus is minimized the replenishment of the carrier liquid to the carrier dispenser 57.

(23) The second preferred embodiment performs the operations of stripping off the carrier liquid 321 and of dispensing the carrier liquid 321 thereby adjusting the toner density in the liquid developer on the intermediate transfer roller 41. However, the toner density may be adjusted by performing either one of the operations.

(24) While the fourth preferred embodiment adjusts the dispersing state of the toner in the liquid developer 32 on the intermediate transfer roller 41, the adjusting operation may also be performed in combination with the operation of the third preferred embodiment for adjusting the dispersing state of the toner in the liquid developer 32 on the photosensitive member 11.

(25) While the foregoing embodiments have been described by way of reference to the printers which print on a transfer sheet an image supplied from the external apparatus such as a host computer, the present invention is not limited to this but is applicable to electrophotographic image forming apparatuses in general including copier machines, facsimile machines and the like. While the foregoing embodiments apply the present invention to the monochromatic image forming apparatuses, the application of the present invention is not limited to this but is also applicable to color image forming apparatuses. In short, the present invention is applicable to the all types of image forming apparatuses in which the toner image developed using the liquid developer with toner dispersed in carrier liquid is transferred to the recording medium, or in which the toner image is temporarily carried on the intermediate transfer medium such as the intermediate transfer roller, intermediate transfer belt or intermediate transfer drum, and then is secondarily transferred to the recording medium.

Although the present invention has been described with reference to specific embodiments, this description is not meant to be construed in a limiting sense. Various modifications of the disclosed embodiments, as well as other embodiments of the present invention, will become apparent to persons skilled in the art upon reference to the description of the present invention. It is therefore contemplated that the appended claim will cover any such modifications or embodiments as fall within the true scope of the present invention.

What is claimed is:

1. An image forming apparatus operating to form a toner image by developing an electrostatic latent image on a latent image carrier using liquid developer with toner dispersed in carrier liquid, to primarily transfer said toner image onto an intermediate transfer medium at a primary transferring position, to transport said toner image on said intermediate transfer medium toward a secondary transferring position, and to secondarily transfer said toner image onto a recording medium under a secondary transfer condition, said apparatus comprising:

a secondary transfer roller disposed to face said intermediate transfer medium at said secondary transferring position;

a transferring bias generator that applies a secondary transferring bias upon said secondary transfer roller to secondarily transfer said toner image on said intermediate transfer medium onto said recording medium;

a fixing unit that fixes said toner image secondarily transferred on said recording medium, wherein said fixing process is only performed after said secondary transfer process; and an adjusting device comprising a dispensing member that dispenses said carrier liquid onto said intermediate transfer medium and a plurality of stripping members that strip off said carrier liquid which is in a surface layer of said liquid developer between said primary transferring position and said secondary transferring position, wherein at least one of the plurality of stripping members is structured to move, and an amount of the carrier liquid that is stripped is controlled by controlling a position of the at least one stripping member that is structured to move, the adjusting device thereby adjusting an amount of carrier liquid contained in said liquid developer adherent to said intermediate transfer medium so as to correspond with said secondary transfer condition, wherein a ratio between said toner and said carrier liquid carried on said intermediate transfer medium is controllable by said adjusting device.

2. The image forming apparatus of claim 1, wherein said amount of carrier liquid on said intermediate transfer medium is adjusted so that a toner density, in said liquid developer which remains on said intermediate transfer medium after said adjusting device has adjusted said amount of carrier liquid, will become closer to a predetermined value corresponding to said secondary transfer condition.

3. The image forming apparatus of claim 1, wherein said adjusting device adjusts said amount of carrier liquid on said intermediate transfer medium according to image information related to said toner image.

4. The image forming apparatus of claim 3, wherein said image information is acquired as an image occupation ratio which is a ratio of an image portion to said electrostatic latent image, and said amount of carrier liquid on said intermediate transfer medium is adjusted in accordance with said image occupation ratio.

5. The image forming apparatus of claim 1, wherein the at least one stripping member that is structured to move is moveable in directions closer to and away from the intermediate transfer medium.

6. The image forming apparatus of claim 5, wherein the plurality of stripping members comprises three stripping members that are moveable in directions closer to and away from the intermediate transfer medium.

7. An image forming method comprising:

a development step for forming a toner image by developing an electrostatic latent image on a latent image carrier using liquid developer with toner dispersed in carrier liquid;

a primary transfer step for primarily transferring said toner image on said latent image carrier onto an intermediate transfer medium;

a secondary transfer step for applying a secondary transferring bias and moving toner making up said toner image on said intermediate transfer medium onto a recording medium through said carrier liquid, to thereby secondarily transfer said toner image onto said recording medium under a secondary transfer condition;

a fix step for fixing said secondarily transferred toner image onto said recording medium, wherein said fix step is performed only after said secondary transfer step; and an adjusting step for dispensing said carrier liquid from a dispensing member onto said intermediate transfer medium or stripping off said carrier liquid which is in a surface layer of said liquid developer adjacent to said intermediate transfer medium with a plurality of stripping members, and moving at least one of the plurality of stripping members to control an amount of the carrier liquid that is stripped, to thereby adjust an amount of carrier liquid contained in said liquid developer before said secondary transfer step is performed so as to correspond with said secondary transfer condition, wherein a ratio between said toner and said carrier liquid on said intermediate transfer medium is controlled in said adjusting step.

8. The image forming method of claim 7, wherein the at least one stripping member that is structured to move is moved in a direction closer to or away from the intermediate transfer medium to control the amount of the carrier liquid that is stripped.

9. The image forming method of claim 8, wherein three stripping members are moved in directions closer to or away from the intermediate transfer medium.

* * * * *